US011474459B2

(12) United States Patent
Miyamoto et al.

(10) Patent No.: US 11,474,459 B2
(45) Date of Patent: Oct. 18, 2022

(54) TRANSFER DEVICE AND IMAGE FORMING APPARATUS

(71) Applicant: FUJIFILM Business Innovation Corp., Tokyo (JP)

(72) Inventors: Yoko Miyamoto, Kanagawa (JP); Kazuyoshi Hagiwara, Kanagawa (JP); Tomoaki Yoshioka, Kanagawa (JP); Toshiaki Baba, Kanagawa (JP); Kazuki Kishi, Kanagawa (JP); Shinji Okuyama, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/370,491

(22) Filed: Jul. 8, 2021

(65) Prior Publication Data

US 2022/0113656 A1 Apr. 14, 2022

(30) Foreign Application Priority Data

Oct. 12, 2020 (JP) ..... JP2020-172149

(51) Int. Cl.
*G03G 15/16* (2006.01)
*G03G 15/00* (2006.01)

(52) U.S. Cl.
CPC ..... *G03G 15/1675* (2013.01); *G03G 15/161* (2013.01); *G03G 15/5004* (2013.01)

(58) Field of Classification Search
CPC ..... G03G 15/1675; G03G 15/2053; G03G 15/2028
See application file for complete search history.

(56) References Cited

U.S. PATENT DOCUMENTS 3,100,112 A * 8/1963 Davis ..... G03G 15/602 271/3.14
3,137,495 A * 6/1964 Eichorn ..... G03G 15/6511 101/232
3,187,651 A * 6/1965 Eichorn ..... G03G 15/30 399/377
3,199,866 A * 8/1965 Eichorn ..... G03G 15/6529 271/204
3,827,800 A * 8/1974 Tanaka ..... G03G 15/18 399/154

(Continued)

FOREIGN PATENT DOCUMENTS

JP 58-005769 A 1/1983

*Primary Examiner* — Sevan A Aydin
(74) *Attorney, Agent, or Firm* — Sughrue Mion, PLLC

(57) ABSTRACT

A transfer device includes: a transfer member to which a voltage is applied by a power supply device to generate a transfer electric field for transferring a developer image to a recording medium; a transfer cylinder having a recess in which a retaining member that retains a leading end portion of the recording medium is disposed, the transfer electric field being generated between the transfer cylinder and the transfer member at a transfer position; a shunt circuit by which the voltage applied to the transfer member is shunted to a reference potential point; and an operation stopping mechanism that starts and stops an operation of the shunt circuit in response to rotation of the transfer cylinder, the operation being started when the recess reaches the transfer position and stopped when the recess leaves the transfer position.

21 Claims, 17 Drawing Sheets

(56) References Cited

U.S. PATENT DOCUMENTS

| | | | | |
|---|---|---|---|---|
| 5,255,056 | A * | 10/1993 | Preszler | B41J 13/223 101/415.1 |
| 5,594,536 | A * | 1/1997 | Kawabata | G03G 15/1655 399/297 |
| 5,708,929 | A * | 1/1998 | Adachi | G03G 15/0216 399/175 |
| 5,799,225 | A * | 8/1998 | Abe | G03G 15/168 399/303 |
| 6,404,999 | B1 * | 6/2002 | Shoji | G03G 15/167 399/314 |
| 2010/0189476 | A1 * | 7/2010 | Tanaka | G03G 15/657 399/313 |
| 2010/0272480 | A1 * | 10/2010 | Kamijo | G03G 15/1675 399/314 |
| 2011/0277317 | A1 * | 11/2011 | Mor-Yosef | G03G 15/75 29/700 |
| 2012/0063820 | A1 * | 3/2012 | Chiba | G03G 15/0189 399/304 |
| 2013/0230343 | A1 * | 9/2013 | Okamoto | G03G 15/1665 399/304 |
| 2017/0205755 | A1 * | 7/2017 | Imaizumi | G03G 15/80 |
| 2017/0212445 | A1 * | 7/2017 | Handa | G03G 15/1695 |
| 2021/0286304 | A1 * | 9/2021 | Shimodaira | G03G 15/5054 |
| 2021/0286305 | A1 * | 9/2021 | Sakamoto | G03G 15/602 |
| 2021/0294264 | A1 * | 9/2021 | Yamada | G03G 15/657 |
| 2021/0325803 | A1 * | 10/2021 | Yamashita | G03G 15/2064 |
| 2022/0032658 | A1 * | 2/2022 | Kodera | B41J 2/0057 |
| 2022/0035278 | A1 * | 2/2022 | Yamada | B41J 13/22 |
| 2022/0035279 | A1 * | 2/2022 | Kodera | B41J 13/22 |
| 2022/0035280 | A1 * | 2/2022 | Yamada | B65H 29/044 |
| 2022/0035285 | A1 * | 2/2022 | Kodera | G03G 15/104 |

* cited by examiner

TRANSFER DEVICE AND IMAGE FORMING APPARATUS

CROSS-REFERENCE TO RELATED APPLICATIONS

This application is based on and claims priority under 35 USC 119 from Japanese Patent Application No. 2020-172149 filed Oct. 12, 2020.

BACKGROUND

(i) Technical Field

The present disclosure relates to a transfer device and an image forming apparatus.

(ii) Related Art

Japanese Unexamined Patent Application Publication No. 58-005769 discloses a technology relating to a transfer device for transferring an image on an image carrier. According to this technology, the transfer device includes transfer-medium transport means that moves a transfer medium along an endless circulation path; a gripper piece that is attached to the transport means, that rotates relative to a table member while being supported by a rotating shaft, and that holds a leading edge of the transfer medium; and a switching member that is attached to the table member. The gripper piece is partially cut at a position of the switching member so that the transfer medium in the gripper unit may be detected.

SUMMARY

The transfer device includes a transfer member to which a voltage is applied by a power supply device to generate a transfer electric field for transferring a developer image to a recording medium, and a transfer cylinder. The transfer electric field is generated between the transfer member and the transfer cylinder at a transfer position. When, for example, the application of the voltage to the transfer member is started or stopped in response to an electric signal, it takes a long time to generate or eliminate the transfer electric field after the electric signal is output.

Aspects of non-limiting embodiments of the present disclosure relate to a technology for reducing the time required to generate or eliminate a transfer electric field compared to when the application of voltage to a transfer member is started or stopped in response to an electric signal.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a transfer device including: a transfer member to which a voltage is applied by a power supply device to generate a transfer electric field for transferring a developer image to a recording medium; a transfer cylinder having a recess in which a retaining member that retains a leading end portion of the recording medium is disposed, the transfer electric field being generated between the transfer cylinder and the transfer member at a transfer position; a shunt circuit by which the voltage applied to the transfer member is shunted to a reference potential point; and an operation stopping mechanism that starts and stops an operation of the shunt circuit in response to rotation of the transfer cylinder, the operation being started when the recess reaches the transfer position and stopped when the recess leaves the transfer position.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
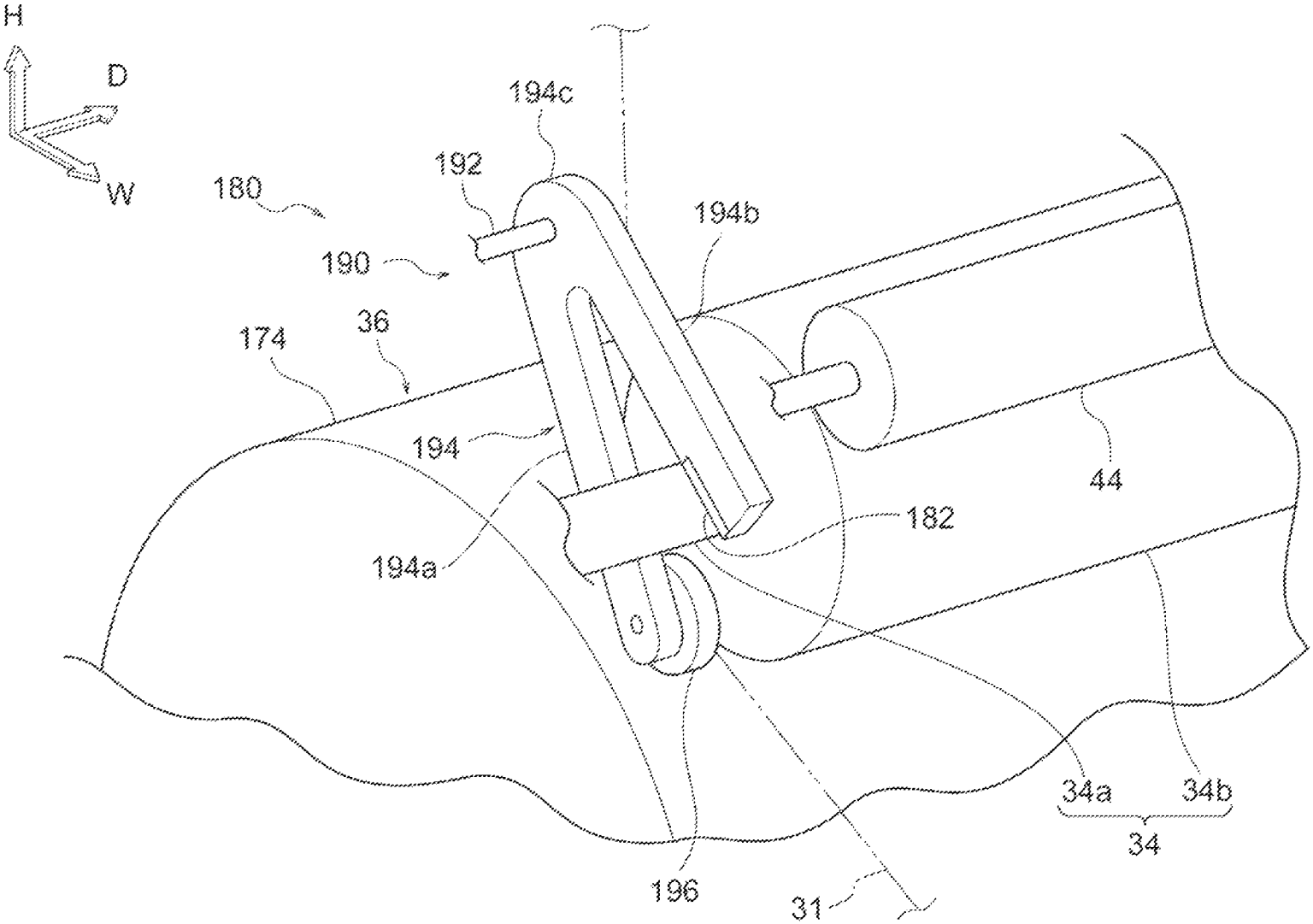
FIG. 1 is a perspective view of a switching unit and other components included in a transfer device according to a first exemplary embodiment of the present disclosure.

Examples of a transfer device and an image forming apparatus according to a first exemplary embodiment of the present disclosure will now be described with reference to FIGS. 1 to 15. In the drawings, arrow H shows an apparatus up-down direction (vertical direction), arrow W shows an apparatus width direction (horizontal direction), and arrow D shows an apparatus depth direction (horizontal direction). FIG. 14 is a schematic diagram that schematically illustrates the overall structure of the image forming apparatus. Therefore, FIG. 14 may differ from other detailed drawings in detail.

Image Forming Apparatus 10

An image forming apparatus 10 according to the present exemplary embodiment illustrated in FIG. 14 is an electrophotographic image forming apparatus that forms a toner image on a sheet member P (see FIGS. 3A, 3B, and 3C) that serves as a recording medium. The image forming apparatus 10 includes a paper feed mechanism 48, an image forming unit 12, a fixing device 100, and a paper output mechanism 56.

Paper Feed Mechanism 48

The paper feed mechanism 48 has a function of transporting the sheet member P, which is stored in a storage unit (not illustrated), to a chain gripper 66, which will be described below.

The paper feed mechanism 48 includes an endless transport belt 48B that is wrapped around a pair of rollers 48A. The transport belt 48B transports the sheet member P and transfers the sheet member P to holding members 76 (see FIG. 6), which will be described below.

Image Forming Unit 12

The image forming unit 12 has a function of electrophotographically forming an image on the sheet member P. The image forming unit 12 includes toner-image forming units 20 that form toner images, and a transfer device 30 that transfers the toner images formed by the toner-image forming units 20 to the sheet member P. The toner images are examples of a developer image, and the toner-image forming units are examples of a developer-image forming unit.

The toner-image forming units 20 are provided to form toner images of different colors. The toner-image forming units 20 included in the image forming unit 12 according to the present exemplary embodiment each correspond to one of four colors, which are yellow (Y), magenta (M), cyan (C), and black (K). The letters 'Y', 'M', 'C', and 'K' attached to the reference numeral represent the respective colors. When it is not necessary to distinguish between yellow (Y), magenta (M), cyan (C), and black (K), the letters 'Y', 'M', 'C', and 'K' after the reference numeral are omitted.

Toner-Image Forming Units 20

The toner-image forming units 20Y, 20M, 20C, and 20K of the respective colors have basically the same structure except for the toner used therein. Therefore, the toner-image forming units 20Y, 20M, 20C, and 20K will not be distinguished from each other based on color in the following description. The toner-image forming units 20Y, 20M, 20C, and 20K are arranged in a horizontal direction above a transfer belt 31 included in the transfer device 30.

Each toner-image forming unit 20 includes a photoconductor drum 21 that rotates in the direction of arrow A01 in FIG. 14 and a charging device 22 that charges the photoconductor drum 21. Each toner-image forming unit 20 also includes an exposure device 23 that forms an electrostatic latent image by exposing the photoconductor drum 21 charged by the charging device 22 to light and a developing device 24 that develops the electrostatic latent image into a toner image.

Transfer Device 30

The transfer device 30 has a function of transferring the toner images formed on the photoconductor drums 21 included in the toner-image forming units 20 of the respective colors onto an intermediate transfer body in a superposed manner in a first transfer process and then transferring the superposed toner images onto the sheet member P in a second transfer process. The transfer device 30 includes the transfer belt 31, which is an example of the intermediate transfer body, plural rollers 32, first transfer rollers 33, a second transfer roller 34, and a transfer cylinder 36. The transfer device 30 also includes an application roller 44 that applies a voltage to the second transfer roller 34 and a chain gripper 66 that transports the sheet member P. The transfer device 30 also includes a grounding unit 180 (see FIG. 1) for grounding the second transfer roller 34.

The transfer belt 31 is an endless belt that is wrapped around the rollers 32 and the second transfer roller 34 to form an inverted rectangular shape. The transfer belt 31 is rotated in the direction of arrow B when at least one of the rollers 32 is rotated.

The first transfer rollers 33 are arranged to face the photoconductor drums 21 of the respective colors with the transfer belt 31 disposed therebetween. The first transfer rollers 33 have a function of transferring the toner images formed on the photoconductor drums 21 to the transfer belt 31 at first transfer positions T between the photoconductor drums 21 and the first transfer rollers 33.

The transfer cylinder 36 has a circular cross-section and is disposed to face the second transfer roller 34 with the transfer belt 31 disposed therebetween. The transfer cylinder 36 has a function of transferring the toner images that have been transferred to the transfer belt 31 to the sheet member P at a second transfer position NT between the transfer belt 31 and the transfer cylinder 36.

Figure 6:
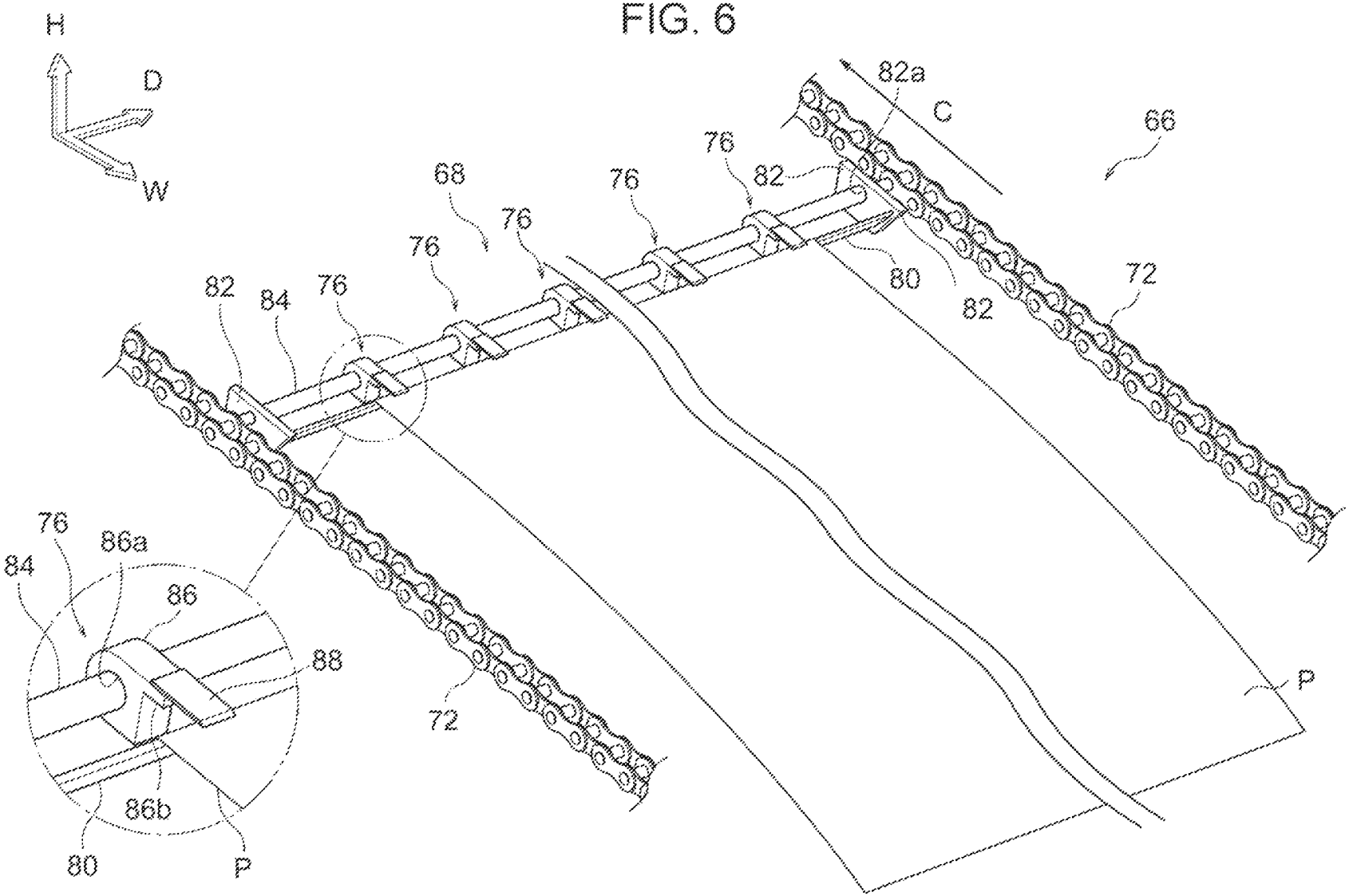
FIG. 6 is a perspective view of a chain gripper included in the transfer device according to the first exemplary embodiment of the present disclosure.

The chain gripper 66 includes a pair of chains 72, sprockets 71 and 73, and holding units 68 which each include holding members 76 that hold the leading end of the sheet member P (see FIG. 6).

Figure 2:
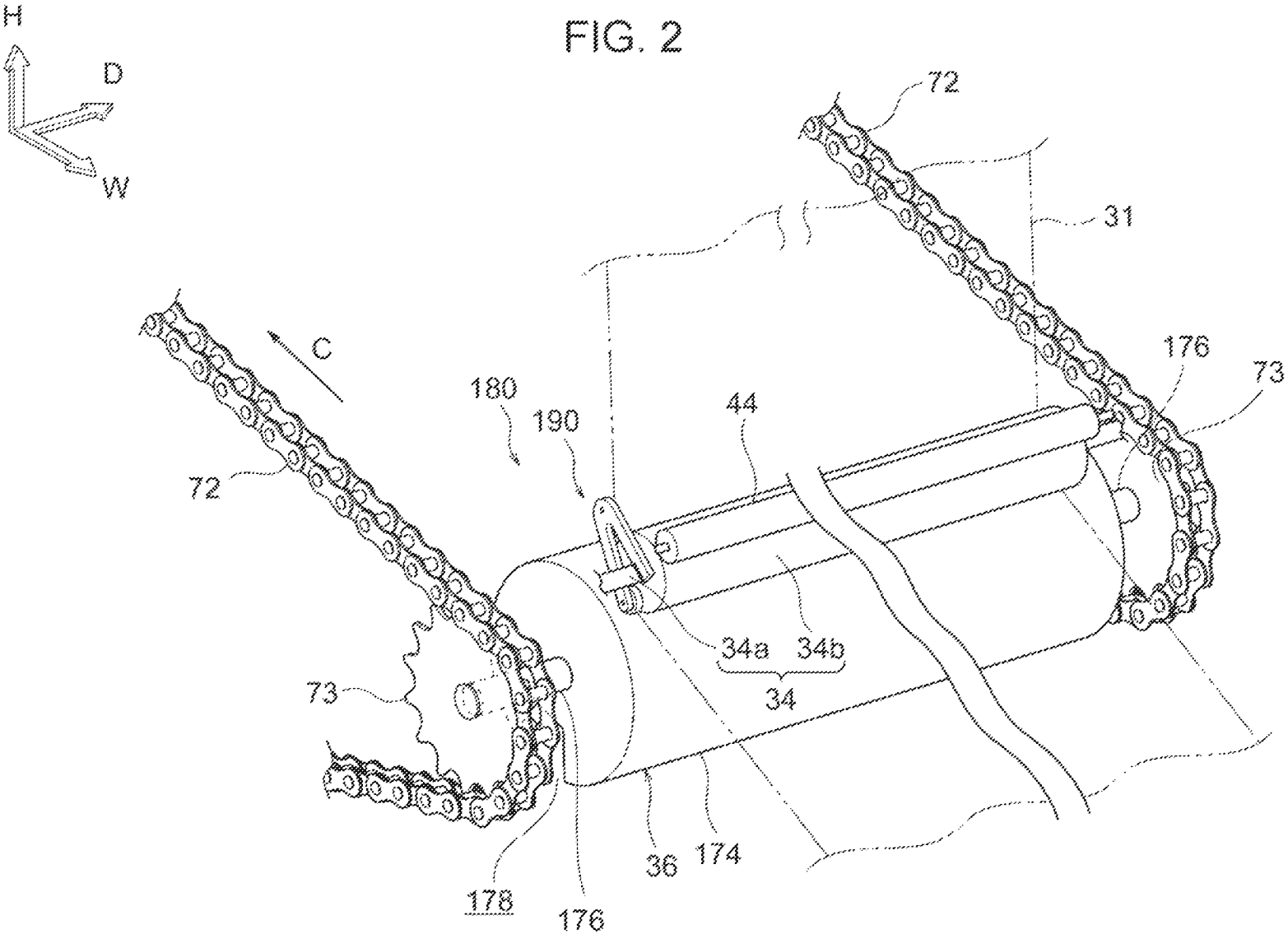
FIG. 2 is a perspective view of a second transfer roller, an opposing roller, the switching unit, and other components included in the transfer device according to the first exemplary embodiment of the present disclosure.

As illustrated in FIG. 6, the pair of chains 72 are endless chains, and are spaced from each other in the apparatus depth direction. As illustrated in FIG. 2, the pair of chains 72 are disposed at one and the other ends of the transfer cylinder 36 in an axial direction of the transfer cylinder 36, and are wrapped around the pair of sprockets 73 that are arranged so that axial directions thereof coincide with the apparatus depth direction.

Figure 15:
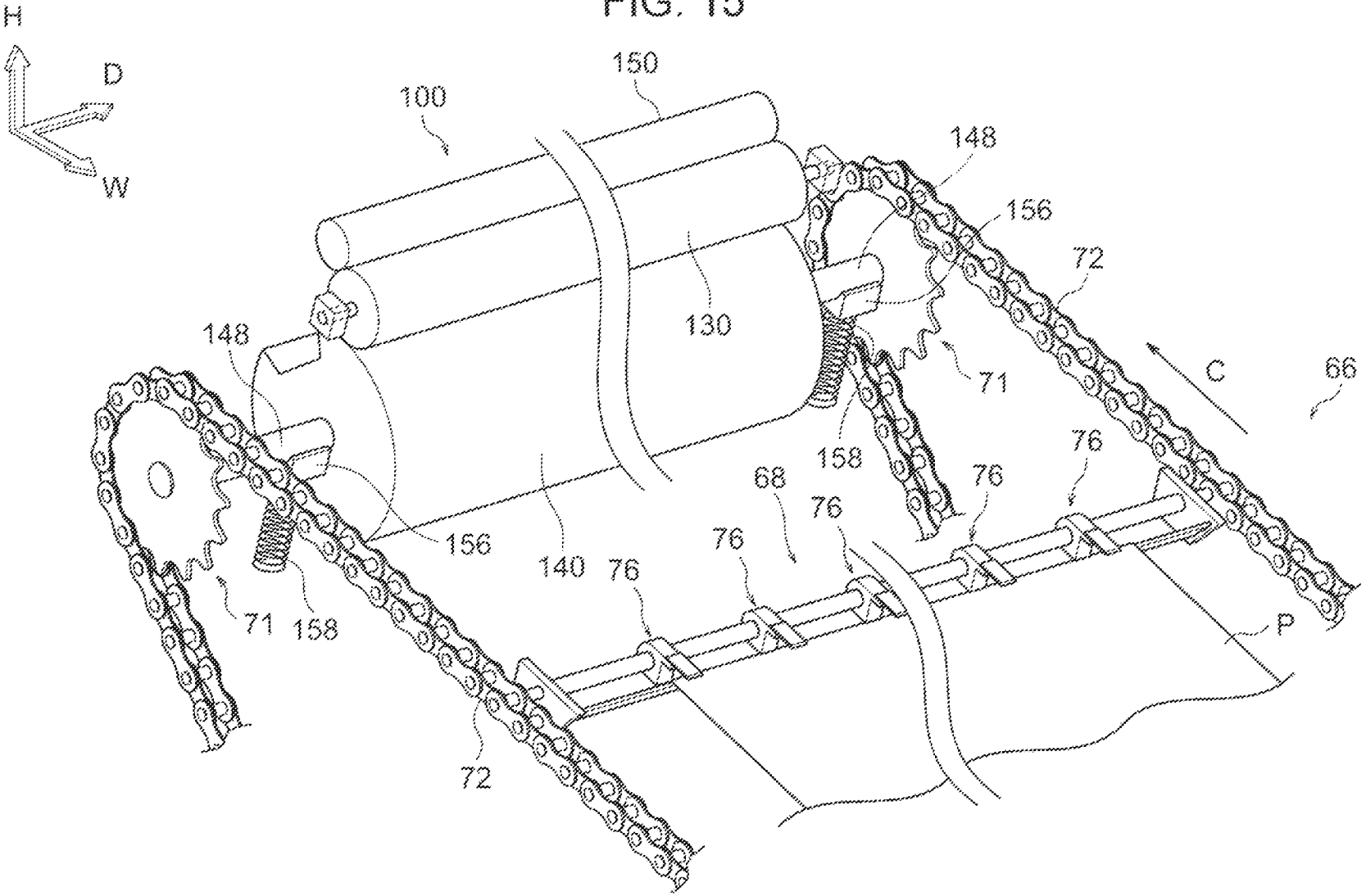
FIG. 15 is a perspective view of a fixing device included in the image forming apparatus according to the first exemplary embodiment of the present disclosure.

As illustrated in FIG. 15, the pair of chains 72 are disposed at one and the other ends of a pressing roller 140, which will be described below, in an axial direction of the pressing roller 140, and are wrapped around the pair of sprockets 71 that are arranged so that axial directions thereof coincide with the apparatus depth direction.

Referring FIG. 14, the chains 72 are wrapped around the sprockets 71 disposed at both ends of the pressing roller 140 and the sprockets 73 disposed at both ends of the transfer cylinder 36. According to this structure, when rotational force is transmitted to one of the sprockets 71 and 73, the pair of chains 72 rotate in the direction of arrow C from the sprockets 73 toward the sprockets 71. In the present exemplary embodiment, rotational force is transmitted to the sprockets 73.

The holding units 68 are arranged at predetermined intervals in the circumferential direction (peripheral direction) of the chains 72. As illustrated in FIG. 6, each holding unit 68 extends in the apparatus depth direction, and both ends thereof in the apparatus depth direction are attached to the respective ones of the pair of chains 72. In addition, each holding unit 68 includes the holding members 76 made of a metal that hold the leading end of the sheet member P.

With this structure, the chain gripper 66 transports the sheet member P in the peripheral direction of the pair of chains 72.

The second transfer roller 34, the application roller 44, the chain gripper 66, and the transfer cylinder 36 included in the transfer device 30 will be described below.

Fixing Device 100

The fixing device 100 illustrated in FIG. 14 has a function of fixing the toner images that have been transferred to the sheet member P by the transfer device 30 to the sheet member P.

As illustrated in FIG. 15, the fixing device 100 includes a heating roller 130 that comes into contact with the sheet member P and heats the sheet member P while the sheet member P is transported; a pressing roller 140 that presses the sheet member P against the heating roller 130; and a driven roller 150 that is rotated by the heating roller 130 and heats the heating roller 130.

The fixing device 100 also includes support members 156 that are in contact with shaft portions 148 of the pressing roller 140 to support the pressing roller 140, and urging members 158 that urge the support members 156 so that the pressing roller 140 is urged against the heating roller 130.

In this structure, the driven roller 150 is rotated by the heating roller 130 that rotates. The sheet member P to which the toner images have been transferred is nipped between and transported by the heating roller 130 and the pressing roller 140, so that the toner images are heated and fixed to the sheet member P.

Paper Output Mechanism 56

The paper output mechanism 56 illustrated in FIG. 14 has a function of outputting the sheet member P to which the toner images have been fixed by the fixing device 100 to an output unit (not illustrated). The paper output mechanism 56 also has a function of receiving the sheet member P that has been released from the holding members 76 (see FIG. 6) and transporting the sheet member P. The paper output mechanism 56 includes an endless transport belt 56B that is wrapped around a pair of rollers 56A. The sheet member P is transported by the transport belt 56B and output to the output unit (not illustrated).

Summary of Image Forming Operation

The image forming apparatus 10 illustrated in FIG. 14 forms a toner image on the sheet member P as follows. First, the charging devices 22 of the respective colors uniformly charge the surfaces of the photoconductor drums 21 of the respective colors to a predetermined negative potential. Subsequently, the exposure devices 23 form electrostatic latent images by emitting exposure light toward the charged surfaces of the photoconductor drums 21 of the respective colors based on image data input from an external unit.

Accordingly, electrostatic latent images that correspond to the image data are formed on the surfaces of the photoconductor drums 21. The developing devices 24 of the respective colors develop and visualize the electrostatic latent images into toner images. The first transfer rollers 33 of the transfer device 30 transfer the toner images formed on the surfaces of the photoconductor drums 21 of the respective colors onto the transfer belt 31 at the first transfer positions T.

The sheet member P fed from the storage unit (not illustrated) is transported and transferred to the chain gripper 66 by the paper feed mechanism 48, and is then transported by the chain gripper 66. The sheet member P transported by the chain gripper 66 is fed to the second transfer position NT, at which the transfer belt 31 and the transfer cylinder 36 are in contact with each other. The sheet member P is nipped between and transported by the transfer belt 31 and the transfer cylinder 36, so that the toner images on the surface of the transfer belt 31 are transferred to the surface of the sheet member P at the second transfer position NT.

The fixing device 100 fixes the toner images that have been transferred to the surface of the sheet member P to the sheet member P. Then, the sheet member P is transported to the paper output mechanism 56. The sheet member P that has been transported to the paper output mechanism 56 is output to the output unit (not illustrated).

Relevant Structures

The chain gripper 66, the second transfer roller 34, the application roller 44, the transfer cylinder 36, an application circuit 400, a shunt circuit 500, and the grounding unit 180 included in the transfer device 30 will now be described.

Chain Gripper 66

As described above, the chain gripper 66 illustrated in FIG. 15 includes the pair of chains 72, the sprockets 71 and 73, and the holding units 68 (see FIG. 6) which each include the holding members 76 that hold the leading end of the sheet member P. The chain gripper 66 is an example of a transport member.

As illustrated in FIG. 6, each holding unit 68 includes a plate portion 80 that extends in the apparatus depth direction, a pair of support plates 82 that support the plate portion 80, and a shaft member 84 that extends in the apparatus depth direction and that is attached to the chains 72 at the ends thereof. The holding unit 68 also includes the holding members 76 that hold the leading end of the sheet member P between the plate portion 80 and themselves.

Plate Portion 80, Support Plates 82, and Shaft Member 84

Referring to FIG. 6, the plate portion 80 is made of stainless steel and is disposed between the pair of chains 72. The plate portion 80 is inclined relative to a sheet transporting direction such that an upstream portion thereof in the sheet transporting direction is closer to the sheet member P than a downstream portion thereof in the sheet transporting direction when viewed in the apparatus depth direction.

The support plates 82, which are made of stainless steel, are disposed on both end portions of the plate portion 80 such that the thickness directions thereof coincide with the apparatus depth direction. The end portions of the plate portion 80 are attached to the pair of support plates 82, and the pair of support plates 82 support the plate portion 80. The support plates 82 have circular through holes 82*a*.

The shaft member 84, which is made of stainless steel, extends in the apparatus depth direction. The shaft member 84 is disposed downstream of the plate portion 80 in the sheet transporting direction. The shaft member 84 extends through the through holes 82*a* formed in the support plates 82. Both end portions of the shaft member 84 are attached to the chains 72.

Holding Members 76

As illustrated in FIG. 6, the holding members 76 are arranged at predetermined intervals in the apparatus depth direction and are attached to the shaft member 84. The holding members 76 each include a body portion 86 having a through hole 86*a* through which the shaft member 84 extends and a contact portion 88 that comes into contact with the sheet member P.

The body portion 86 is made of aluminum, and a downstream portion of the body portion 86 in the sheet transporting direction is arc shaped when viewed in the apparatus depth direction. An upstream portion of the body portion 86 in the sheet transporting direction has a projecting portion 86*b*, which projects toward the plate portion 80, at a side thereof that faces the region outside the endless chains 72 (side facing away from the region surrounded by the endless chains 72 when viewed in the apparatus depth direction). The projecting portion 86*b* has a rectangular shape when viewed in a direction in which the projecting portion 86*b* projects.

The contact portion 88 is a plate member made of a stainless steel, and is attached to a surface of the projecting portion 86*b* that faces the region outside the endless chains 72. The contact portion 88 extends toward the plate portion 80 from the projecting portion 86*b*, and comes into contact with the plate portion 80 in a direction from the region outside the endless chains 72.

In this structure, the shaft member 84 is rotated by a cam mechanism (not illustrated) so that the contact portion 88 is moved toward and into contact with the plate portion 80 in the direction from the region outside the endless chains 72 or is moved away from the plate portion 80. Thus, each holding member 76 holds or releases the leading end of the sheet member P.

Second Transfer Roller 34

As illustrated in FIG. 2, the second transfer roller 34 extends in the apparatus depth direction, and the transfer belt 31 is wrapped around the second transfer roller 34. The second transfer roller 34 includes a shaft member 34*a* and a tube-shaped roller portion 34*b* through which the shaft member 34*a* extends. The second transfer roller 34 is an example of a transfer member. The apparatus depth direction is an example of an axial direction.

The shaft member 34*a* may be a stainless steel shaft, and both end portions of the shaft member 34*a* are supported by bearings on a frame (not illustrated). The roller portion 34*b* is made of rubber, and is attached to the shaft member 34*a* such that the roller portion 34*b* rotates together with the shaft member 34*a*. The shaft member 34*a* may be any conductive member, and may be made of a metal, such as stainless steel.

In this structure, the second transfer roller 34 is rotated by the transfer belt 31 that rotates.

Application Roller 44

As illustrated in FIG. 2, the application roller 44, which is an example of an application member, has a diameter less than that of the second transfer roller 34, and is disposed to face the transfer belt 31 with the second transfer roller 34 disposed therebetween. The application roller 44 extends in the apparatus depth direction, and is in contact with the outer peripheral surface of the second transfer roller 34.

In this structure, the application roller 44 is rotated by the second transfer roller 34 that rotates. A power supply device 410 (see FIG. 10) supplies electricity to a shaft portion of the application roller 44, so that a voltage is applied to the second transfer roller 34. Accordingly, a transfer electric field for transferring the toner images on the transfer belt 31 to the sheet member P is generated at the second transfer position NT between the second transfer roller 34 and the transfer cylinder 36.

Transfer Cylinder 36

As illustrated in FIG. 2, the transfer cylinder 36 is disposed to face the second transfer roller 34 with the transfer belt 31 disposed therebetween. The transfer cylinder 36 extends in the apparatus depth direction.

The transfer cylinder 36 includes a roller portion 174 and a pair of shaft portions 176 that project from both ends of the roller portion 174 in the apparatus depth direction. The roller portion 174 projects from the roller portion 34*b* of the second transfer roller 34 in the apparatus depth direction. The above-described sprockets 73 are attached to the pair of shaft portions 176.

Figures 3A, 3B, 3C:
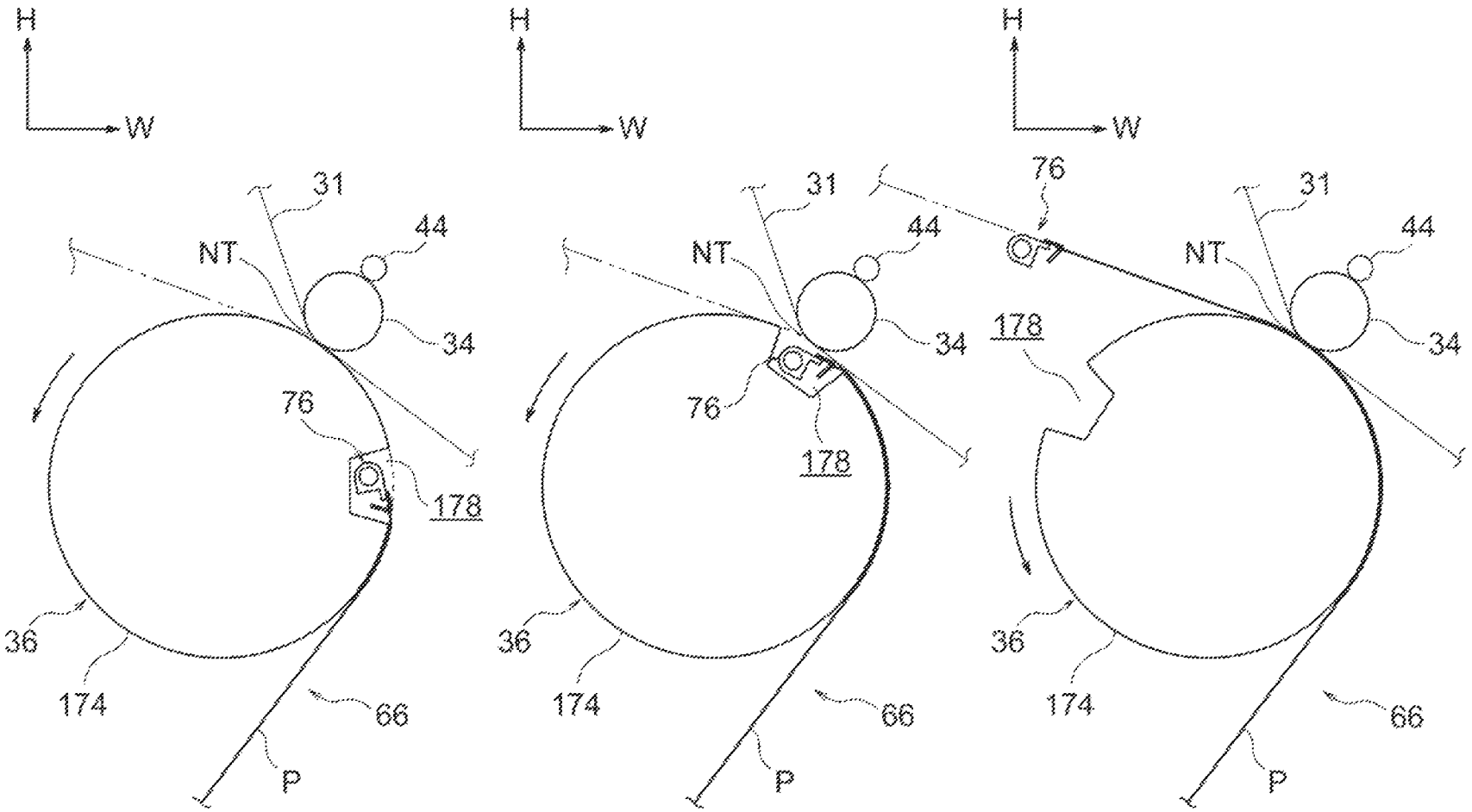
FIGS. 3A, 3B, and 3C are operation diagrams illustrating a sheet-member-transporting operation performed by the transfer device according to the exemplary embodiment of the present disclosure.

As illustrated in FIG. 3A, the roller portion 174 of the transfer cylinder 36 has a recess 178 in which the holding members 76 are disposed. The recess 178 extends from one end to the other end of the roller portion 174 in the apparatus depth direction.

In this structure, as illustrated in FIG. 3A, when the holding members 76 holding the leading end of the sheet member P reach the transfer cylinder 36 that rotates, the holding members 76 are received by the recess 178 in the roller portion 174. Then, as illustrated in FIG. 3B, the sheet member P having its leading end held by the holding members 76 is transported while being wrapped around the transfer cylinder 36 that rotates, and is nipped between the roller portion 174 and the transfer belt 31 at the second transfer position NT. Thus, the sheet member P is transported while being wrapped around the transfer cylinder 36. In other words, the transfer cylinder 36 functions as support means that supports the sheet member P.

The toner images on the transfer belt 31 are transferred to the sheet member P by the transfer electric field at the second transfer position NT.

Then, as illustrated in FIG. 3C, the holding members 76 that have been disposed in the recess 178 in the roller portion 174 leave the recess 178 in the transfer cylinder 36 that rotates, and the chain gripper 66 transports the sheet member P downstream in the sheet transporting direction.

Figure 7:
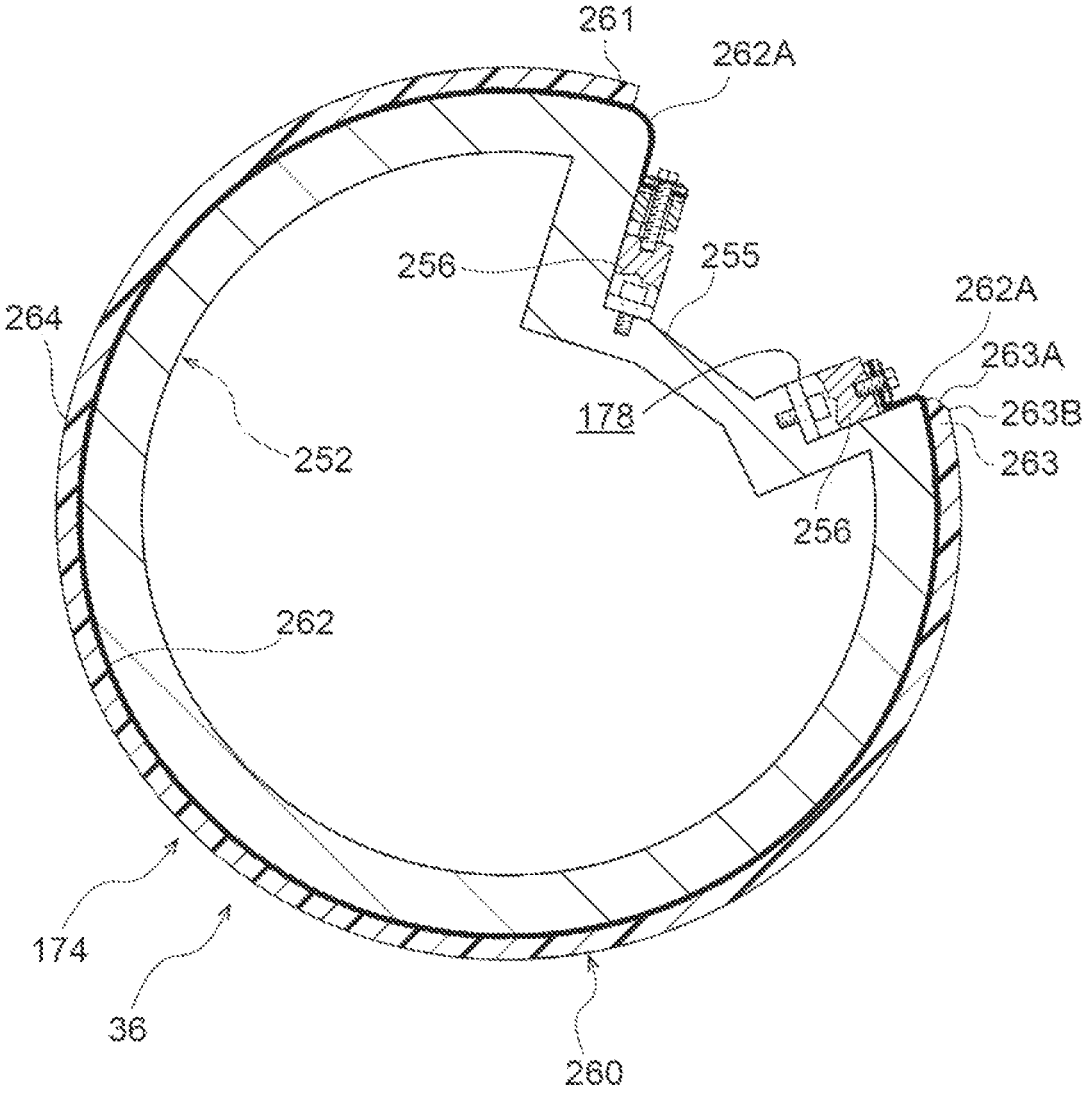
FIG. 7 is a sectional view of a transfer cylinder according to the first exemplary embodiment of the present disclosure taken along a plane orthogonal to an axial direction.

As illustrated in FIG. 7, the roller portion 174 of the transfer cylinder 36 includes a cylinder body 252 made of a metal, such as aluminum, and a sheet-shaped jacket member 260, which is an example of an outer peripheral portion that is wrapped around the cylinder body 252. The above-described recess 178 that extends in the axial direction is formed in a portion of the outer peripheral surface of the cylinder body 252.

The jacket member 260 is made of a resin and has a volume resistance greater than that of the cylinder body 252, which is made of a metal. The jacket member 260 includes a base layer 262 that is wrapped around the cylinder body 252 without being bonded to the cylinder body 252 and a surface layer 264 that is wrapped around and bonded to the outer peripheral surface of the base layer 262. Cylinder blocks 256 are provided on a bottom wall 255 of the recess 178 at both ends thereof in the circumferential direction. End portions 262A of the base layer 262 of the jacket member 260 are fastened to the cylinder blocks 256 with bolts so that the base layer 262 is detachably attached to the cylinder body 252. In other words, the jacket member 260 is replaceable.

Figure 8A:
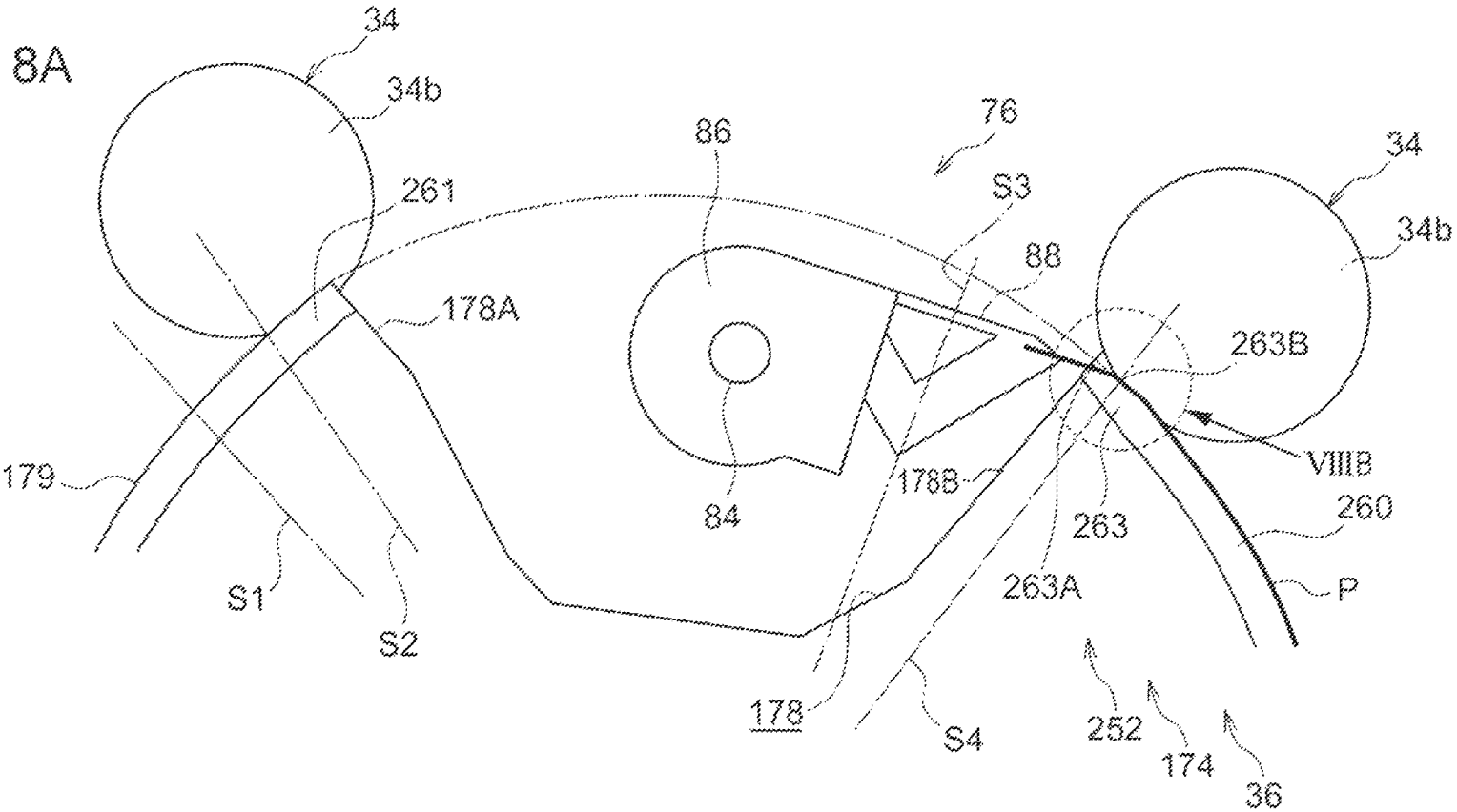
FIG. 8A is a schematic diagram that schematically illustrates the manner in which a second transfer roller reaches and leaves a recess in the transfer cylinder of the transfer device according to the exemplary embodiment of the present disclosure.

As illustrated in FIG. 8A, one end portion 261 of the jacket member 260 is flush with or substantially flush with a wall surface 178A of the recess 178 at one end of the recess 178. The other end portion 263 of the jacket member 260 is flush with or substantially flush with a wall surface 178B of the recess 178 at the other end of the recess 178.

Figure 8B:
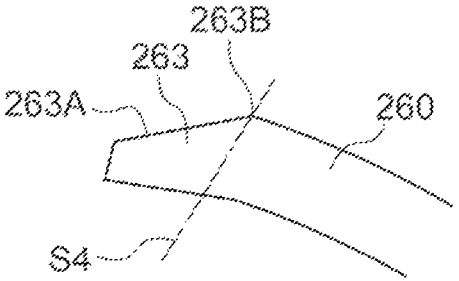
FIG. 8B is an enlarged view of part VIIIB in FIG. 8A.

As illustrated in FIGS. 8A and 8B, the other end portion 263 of the jacket member 260 has an inclined surface 263A that is inclined such that the thickness of the jacket member 260 decreases toward a front end thereof. A back end of the inclined surface 263A is defined as an inclination end 263B.

FIG. 8A illustrates two second transfer rollers 34. The reason for this will be described below.

Grounding Unit 180

As illustrated in FIG. 1, the grounding unit 180, which is an example of an operation stopping mechanism, is disposed in front of the roller portion 34*b* of the second transfer roller 34 in the apparatus depth direction. The grounding unit 180 includes a grounding member 182 and a switching member 190. The grounding member 182 comes into contact with the shaft member 34*a* of the second transfer roller 34 to connect the second transfer roller 34 to ground. The switching member 190 moves the grounding member 182 into contact with and away from the shaft member 34*a*.

When viewed in the apparatus width direction, the switching member 190 has a U-shape that is open at an upstream end thereof in the sheet transporting direction. The switching member 190 includes a rotating shaft portion 192, a body portion 194, and a contact roller 196.

The body portion 194 is made of a resin and includes a pair of straight portions 194*a* and 194*b* and a curved portion 194*c* that connects base ends of the pair of straight portions 194*a* and 194*b*. The straight portion 194*a* is disposed between the transfer cylinder 36 and the shaft member 34*a* when viewed in the apparatus depth direction. The straight portion 194*b* is disposed to face the straight portion 194*a* with the shaft member 34*a* disposed therebetween when viewed in the apparatus depth direction. The straight portion 194*b* is an example of a support portion.

The rotating shaft portion 192 is supported by a frame (not illustrated) and extends through the curved portion 194*c* of the body portion 194 such that an axial direction thereof coincides with the apparatus depth direction. The rotating shaft portion 192 rotatably supports the body portion 194.

The straight portion 194*b* supports the grounding member 182. More specifically, the grounding member 182 is attached to an end portion of the straight portion 194*b* at a side facing the shaft member 34*a*, and is thereby supported by the straight portion 194*b*.

The grounding member 182, which may be made of steel, is connected to a grounding wire (not illustrated). The second transfer roller 34 is grounded when the grounding member 182 comes into contact with the shaft member 34*a*. The grounding member 182 may be any conductive member, and may be made of a metal, such as steel.

The contact roller 196 is attached to an end portion of the straight portion 194*a*, and rotates around an axis that extends in the apparatus depth direction. The contact roller 196 is urged toward the outer peripheral surface of the roller portion 174 of the transfer cylinder 36 by an urging member (not illustrated) disposed on the rotating shaft portion 192. The contact roller 196 is an example of a contact portion.

Figure 4B:
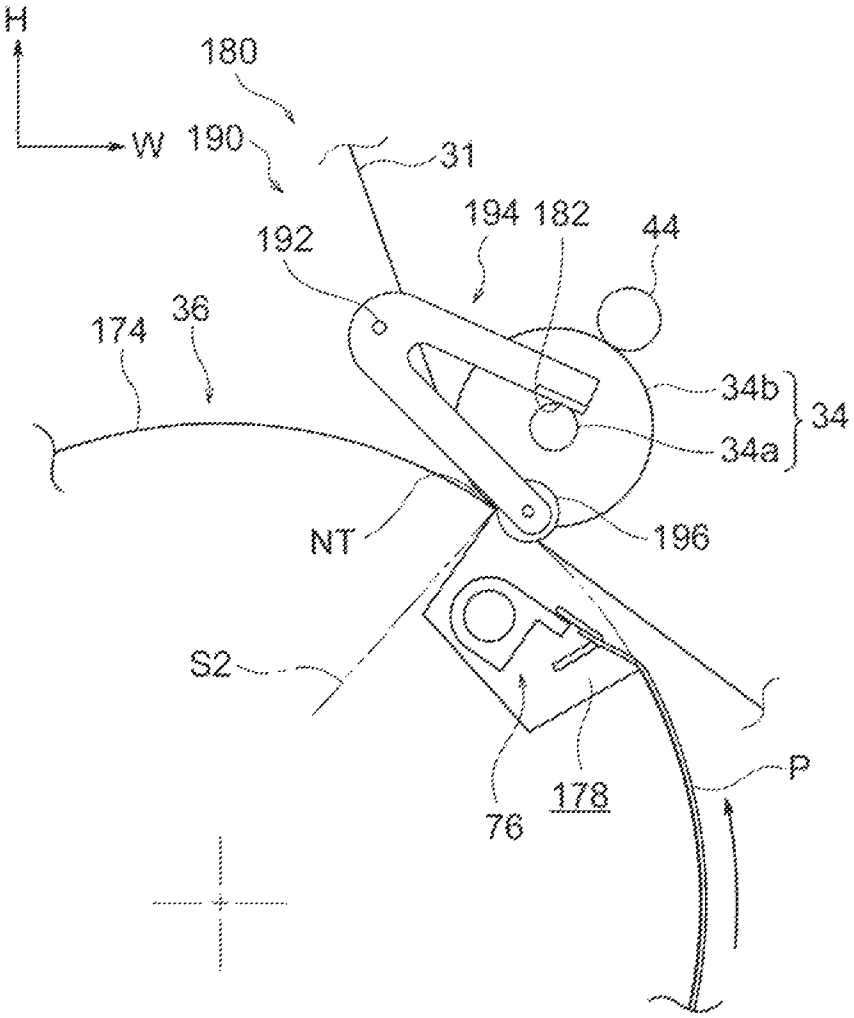
FIGS. 4A and 4B are operation diagrams illustrating a switching operation performed by the switching unit included in the transfer device according to the exemplary embodiment of the present disclosure.
Figure 4A:
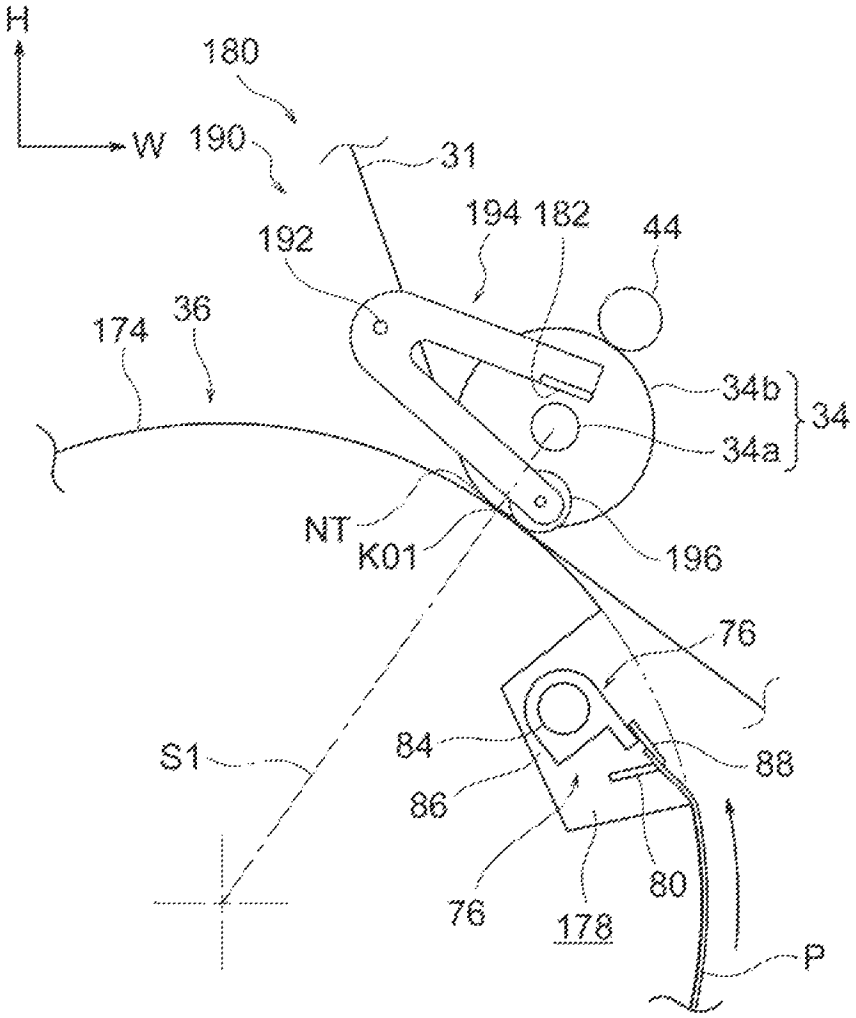

When the contact roller 196 is in contact with the outer peripheral surface of the roller portion 174 of the transfer cylinder 36, the grounding member 182 is separated from the shaft member 34*a* (see FIG. 4A). When the contact roller 196 is disposed in the recess 178 in the transfer cylinder 36, the grounding member 182 is in contact with the shaft member 34*a* (see FIG. 4B). Thus, the outer peripheral surface of the roller portion 174 and the recess 178 function as a cam surface, and the contact roller 196 functions as a cam follower.

More specifically, as illustrated in FIG. 4A and FIG. 4B, the contact roller 196 that is in contact with the outer peripheral surface of the roller portion 174 reaches the downstream end of the recess 178 in the rotation direction before the second transfer roller 34 reaches the downstream end of the recess 178 in the rotation direction. In other words, the contact roller 196 that is in contact with the outer peripheral surface of the roller portion 174 reaches the downstream end of the recess 178 in the rotation direction before the second transfer position NT reaches the downstream end of the recess 178 in the rotation direction.

When viewed in the apparatus depth direction, the intersection point between the line connecting the rotation center of the second transfer roller 34 and the rotation center of the transfer cylinder 36 (lines S1 to S4 described below) and the outer peripheral surface of the second transfer roller 34 is defined as an intersection point K01 (see FIG. 4A). The expressions "before the second transfer roller 34 reaches the downstream end of the recess 178 in the rotation direction" and "before the second transfer position NT reaches the downstream end of the recess 178 in the rotation direction" mean before the intersection point K01 reaches the downstream end of the recess 178 in the rotation direction.

Figure 5B:
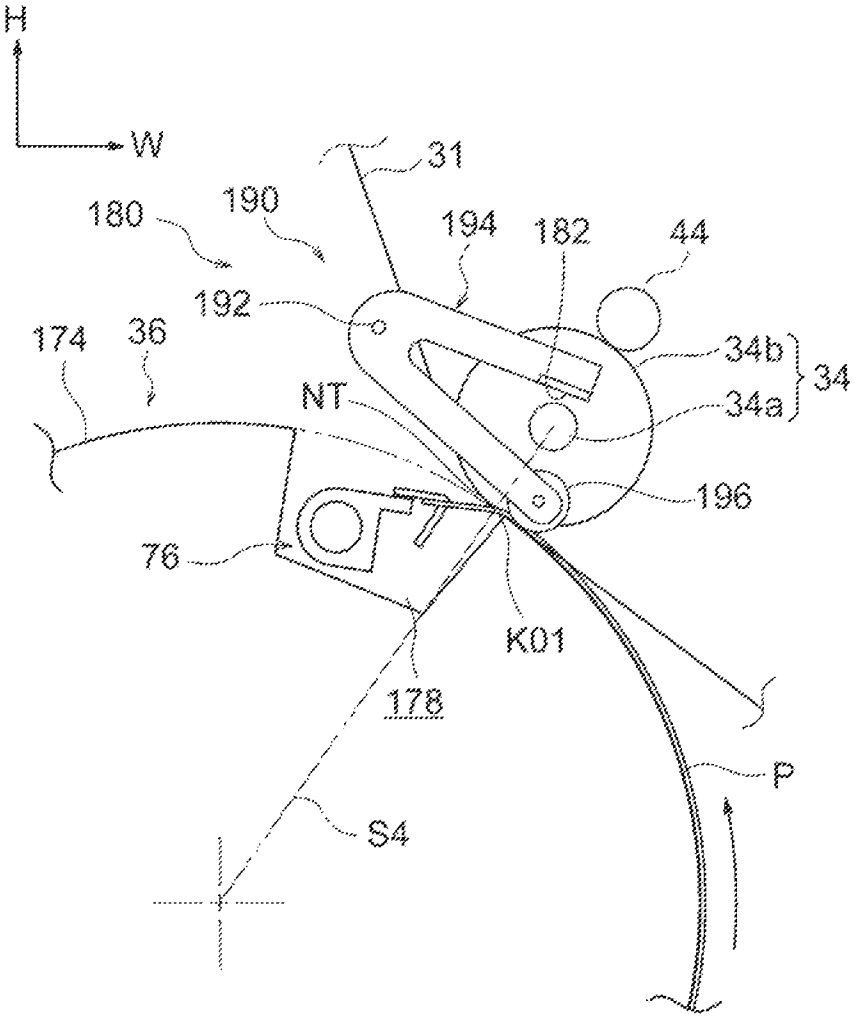
FIGS. 5A and 5B are operation diagrams illustrating the switching operation performed by the switching unit included in the transfer device according to the exemplary embodiment of the present disclosure.
Figure 5A:
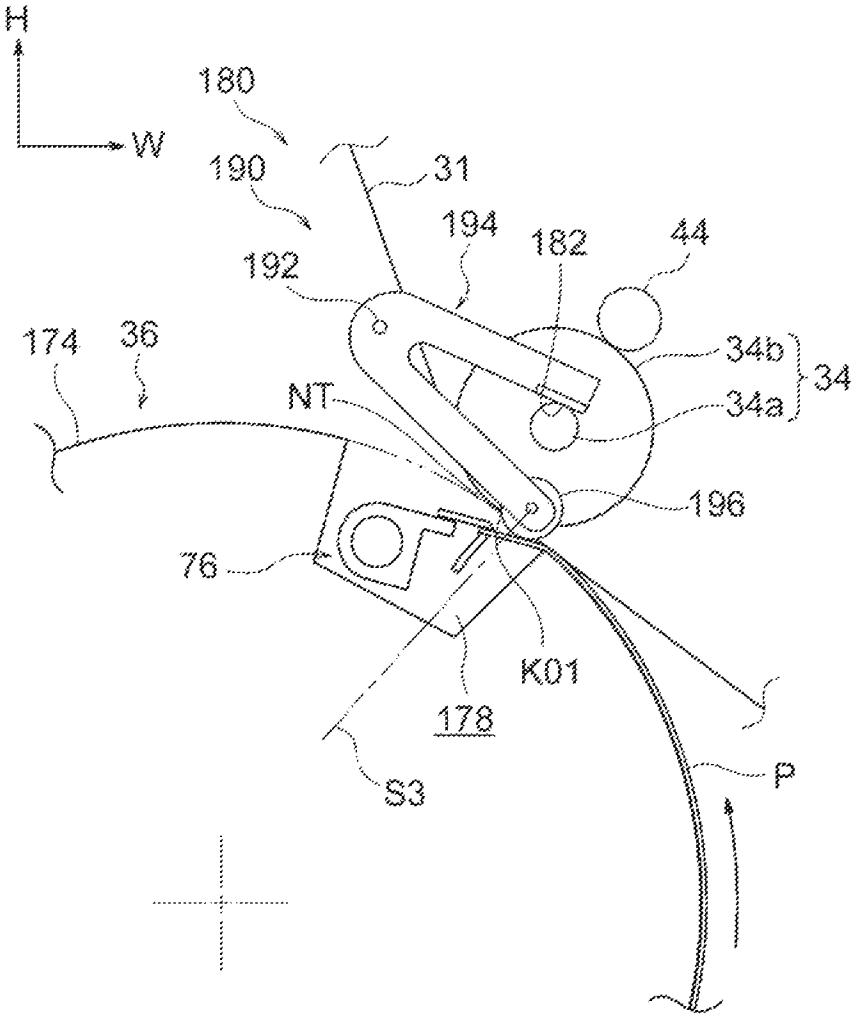

As illustrated in FIGS. 5A and 5B, the contact roller 196 that has reached the downstream end of the recess 178 in the rotation direction reaches the outer peripheral surface of the transfer cylinder 36 after the holding members 76 have passed the second transfer roller 34. In other words, the contact roller 196 that has reached the downstream end of the recess 178 in the rotation direction reaches the outer peripheral surface of the transfer cylinder 36 after the holding members 76 have passed the second transfer position NT.

The expressions "after the holding members 76 have passed the second transfer roller 34" and "after the holding members 76 have passed the second transfer position NT" mean after the holding members 76 have passed the intersection point K01 when viewed in the apparatus depth direction.

A wrapped portion of the outer peripheral surface of the transfer cylinder 36 that is wrapped with the sheet member P reaches the second transfer roller 34 after the contact roller 196 has reached the outer peripheral surface of the transfer cylinder 36. In other words, the wrapped portion of the outer peripheral surface of the transfer cylinder 36 that is wrapped with the sheet member P reaches the second transfer position NT after the contact roller 196 has reached the outer peripheral surface of the transfer cylinder 36. In other words, the contact roller 196 disposed in the recess 178 comes into contact with the outer peripheral surface of the transfer cylinder 36 before the second transfer roller 34 reaches the portion of the outer peripheral surface of the transfer cylinder 36 that is wrapped with the sheet member P. A portion of the sheet member P between a portion held by the holding members 76 and a portion wrapped around the outer peripheral surface of the transfer cylinder 36 is not included in the wrapped portion.

The expression "before the second transfer roller 34 reaches the portion of the outer peripheral surface of the transfer cylinder 36 that is wrapped with the sheet member P" means before the intersection point K01 reaches the portion of the outer peripheral surface of the transfer cylinder 36 that is wrapped with the sheet member P when viewed in the apparatus depth direction.

When the second transfer roller 34 faces the portion of the transfer cylinder 36 that is wrapped with the sheet member P, the grounding member 182 is separated from the shaft member 34*a*. In other words, when the second transfer roller 34 faces the portion of the transfer cylinder 36 that is wrapped with the sheet member P, a transfer electric field is generated at the second transfer position NT.

The expression "the second transfer roller 34 faces the portion of the transfer cylinder 36 that is wrapped with the sheet member P" means that the intersection point K01 is on the portion of the transfer cylinder 36 that is wrapped with the sheet member P when viewed in the apparatus depth direction.

Figure 9:
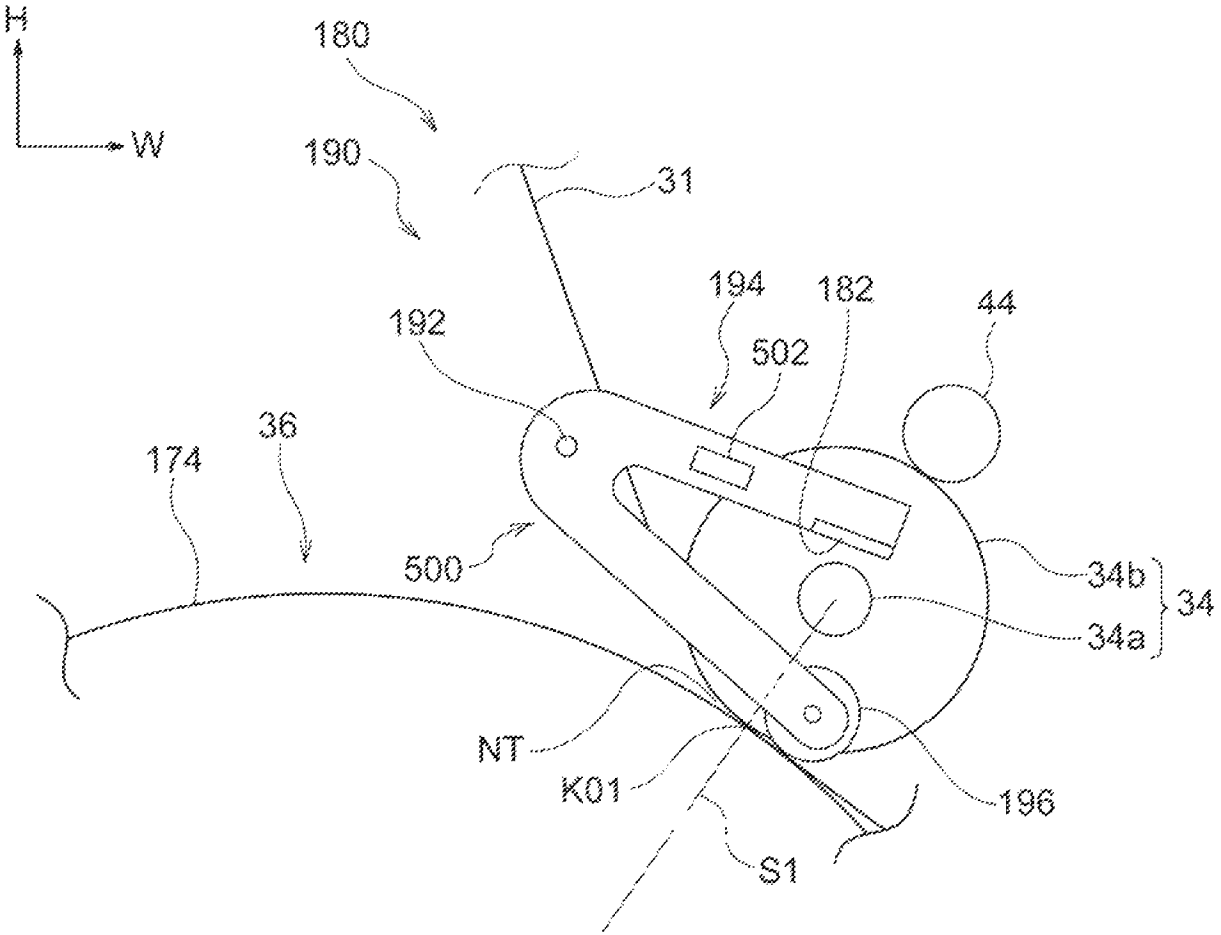
FIG. 9 is a front view of the switching unit of the transfer device according to the first exemplary embodiment of the present disclosure.

As illustrated in FIG. 9, a resistive element 502 is provided on the body portion 194 of the switching member 190 of the grounding unit 180. The grounding member 182 is electrically connected to a reference potential point G (see FIGS. 10 and 11) through the resistive element 502. In the present exemplary embodiment, the grounding member 182 is electrically connected to the rotating shaft portion 192 through the resistive element 502, and the rotating shaft portion 192 is electrically connected to the reference potential point G (see FIGS. 10 and 11).

The resistance value of the resistive element 502 is set in the range of greater than or equal to 1 MΩ and less than or equal to 4 MΩ, and is set to about ½ of the volume resistance value of the second transfer roller 34 at the time when the transfer electric field is generated. In the present exemplary embodiment, the resistance value of the resistive element 502 is 2.5 MΩ.

Referring to FIGS. 4A and 5B, when the contact roller 196 is in contact with the outer peripheral surface of the roller portion 174 of the transfer cylinder 36, the grounding member 182 is separated from the shaft member 34*a*. Therefore, the current generated when a voltage is applied to the second transfer roller 34 by the application roller 44 flows to the transfer cylinder 36, and the transfer electric field is generated at the second transfer position NT.

As illustrated in FIGS. 4B and 5A, when the contact roller 196 is disposed in the recess 178, the grounding member 182 is in contact with the shaft member 34*a*. Therefore, the current generated when a voltage is applied to the second transfer roller 34 by the application roller 44 flows to the grounding member 182, and is shunted to the reference potential point G (see FIGS. 10 and 11) through the resistive element 502 (see FIG. 9). Thus, the transfer electric field that has been generated at the second transfer position NT is eliminated.

Thus, the switching member 190 functions as path switching means that switches a current path for the current from the second transfer roller 34 so that the current flows to a shunt circuit 500 (see FIGS. 10 and 11) described below. The timing, for example, for switching to the shunt circuit 500 will be described below.

In FIGS. 4A, 4B, 5A, and 5B, lines S1, S2, S3, and S4 show positions corresponding to the second transfer position NT. More specifically, the intersection point K01 (see FIG. 4A), which is the intersection point between each of these lines and the outer peripheral surface of the second transfer roller 34, is the second transfer position NT.

Application Circuit 400 and Shunt Circuit 500

Figure 10:
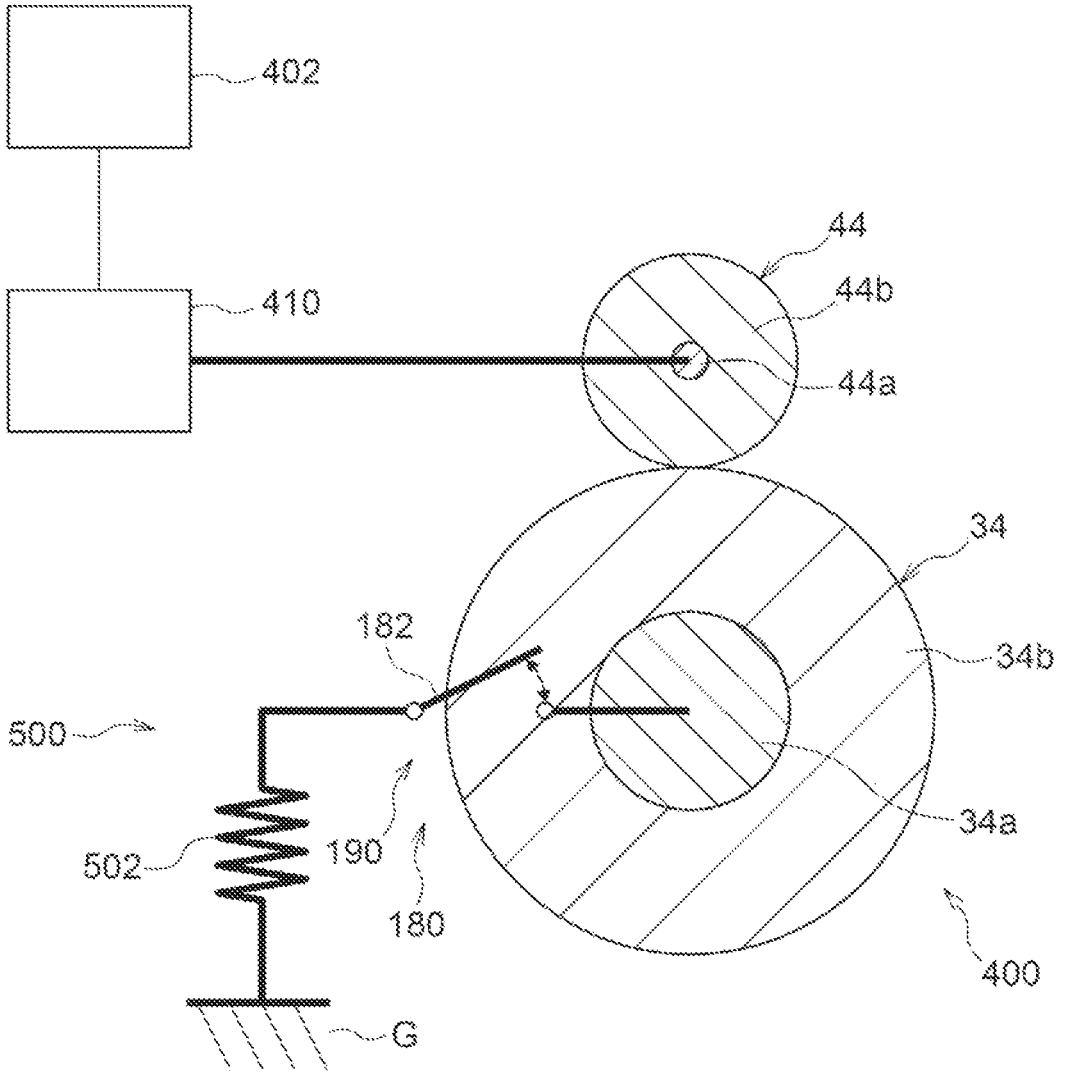
FIG. 10 is a connection diagram of an application circuit and a shunt circuit of the transfer device according to the first exemplary embodiment of the present disclosure.
Figure 11:
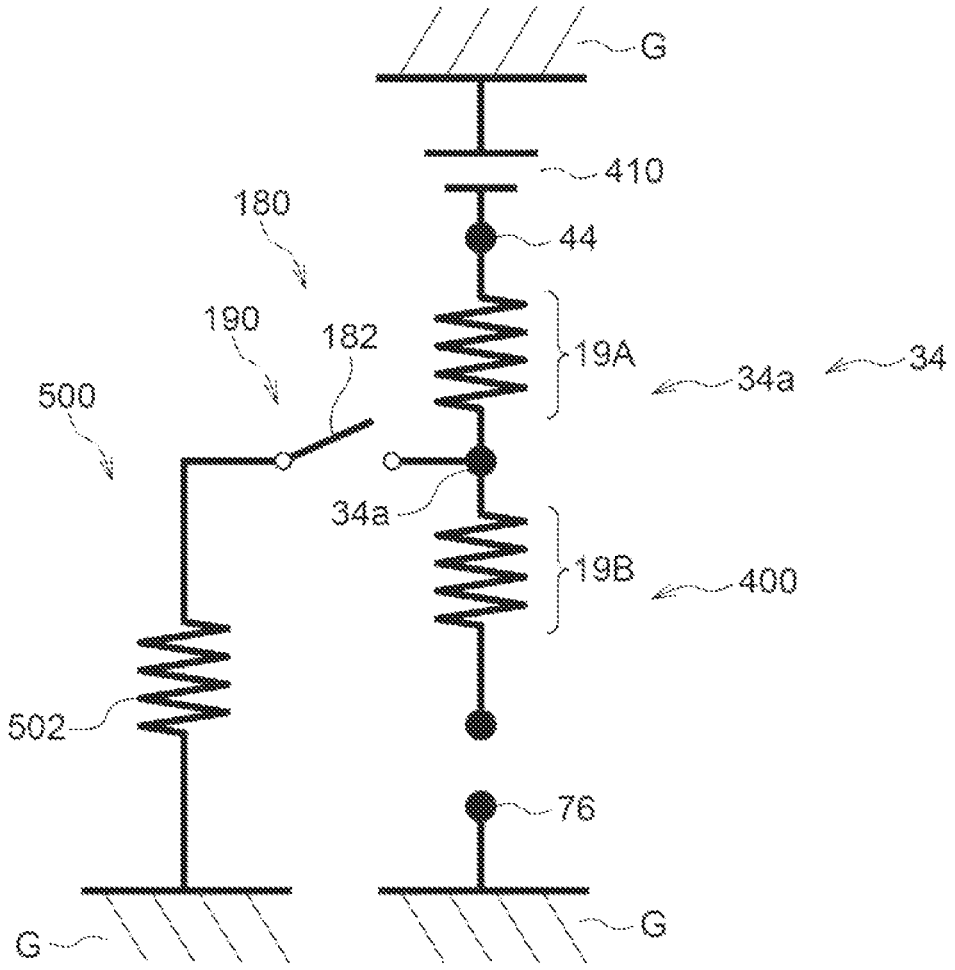
FIG. 11 is an equivalent circuit diagram of the connection diagram illustrated in FIG. 10.

FIG. 10 is a connection diagram of the application circuit 400 that applies a high voltage to the second transfer roller 34 and the shunt circuit 500. FIG. 11 is an equivalent circuit diagram of the connection diagram illustrated in FIG. 10.

The application circuit 400 includes the power supply device 410, the application roller 44, and the second transfer roller 34. The application roller 44 includes a shaft member 44*a* and a tube-shaped roller portion 44*b* through which the shaft member 44*a* extends. As described above, the power supply device 410 supplies electricity to the shaft member 44*a* of the application roller 44 so that a voltage is applied to the second transfer roller 34 and that the transfer electric field is generated at the second transfer position NT (see, for example, FIGS. 4A and 4B).

The shunt circuit 500 includes the above-described grounding member 182 and the resistive element 502. As described above, when the grounding member 182 comes into contact with the shaft member 34*a*, the generated current is switched to the shunt circuit 500 and shunted to the reference potential point G through the grounding member 182 and the resistive element 502. Accordingly, the transfer electric field that has been generated at the second transfer position NT (see, for example, FIGS. 4A and 4B) is eliminated.

Power Supply Device 410

Figure 12:
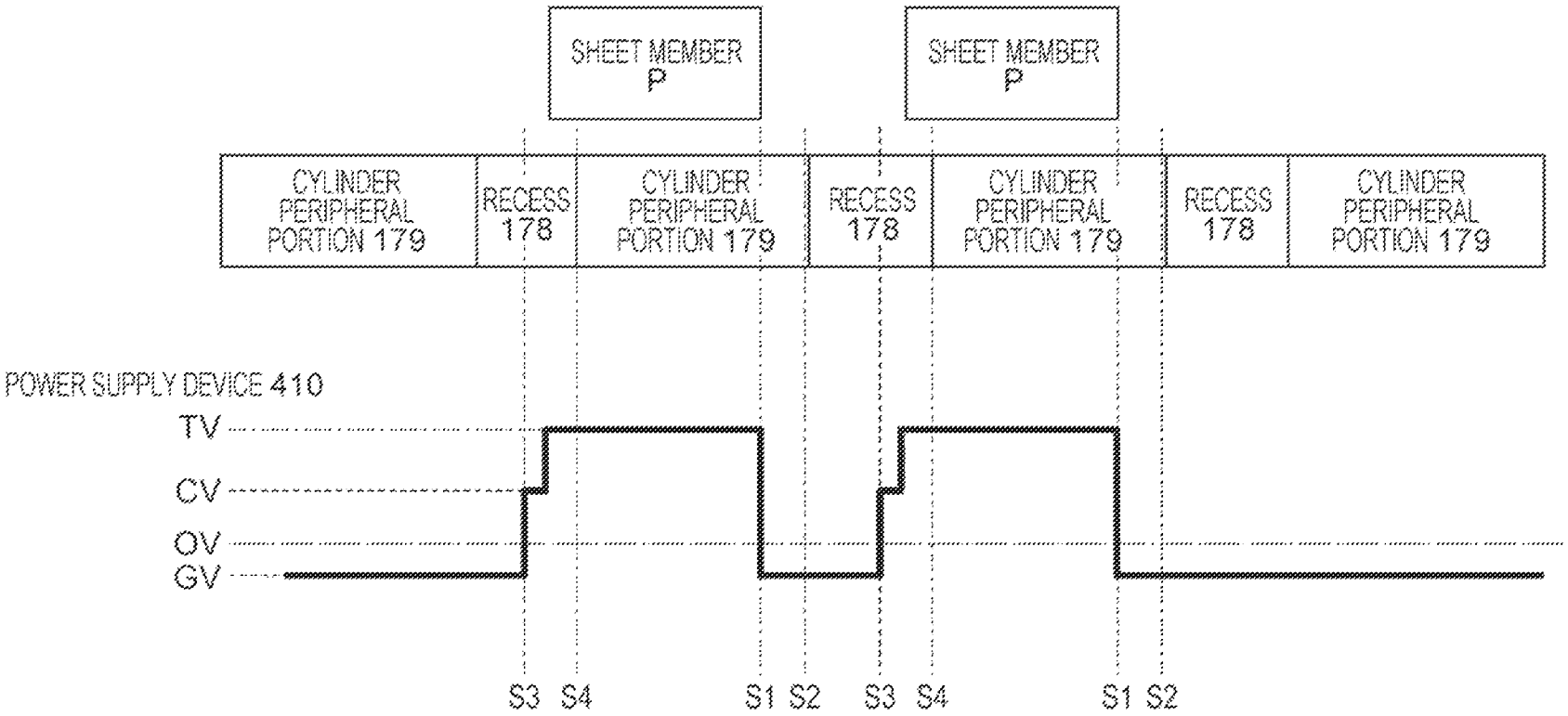
FIG. 12 is a timing chart illustrating the timing for changing a voltage applied by a power supply device for the transfer device according to the first exemplary embodiment of the present disclosure.

As illustrated in FIG. 12, the power supply device 410 is capable of switching the voltage applied to the application roller 44 (see FIG. 10) between a transfer voltage TV, a reverse voltage GV, and an intermediate voltage CV. FIG. 12 is a timing chart illustrating the timing for switching the voltage as described below.

The transfer voltage TV is a voltage applied to generate the transfer electric field at the second transfer position NT (see, for example, FIGS. 4A and 4B). The reverse voltage GV is a voltage having a polarity opposite to that of the transfer voltage TV and an absolute value less than that of the transfer voltage TV. The intermediate voltage CV is a voltage that has the same polarity as that of the transfer voltage TV and that is between the transfer voltage TV and the reverse voltage GV. The intermediate voltage CV is set to CV=TV/2 in the present exemplary embodiment, but is not limited to this.

The power supply device 410 switches between the transfer voltage TV, the reverse voltage GV, and the intermediate voltage CV in response to an electric signal from a control device 402 (see FIG. 10). In the present exemplary embodiment, switching between the transfer voltage TV, the reverse voltage GV, and the intermediate voltage CV is carried out based on a reference signal used to control various timings in the overall operation of the image forming apparatus 10. More specifically, switching is carried out after a set time period has elapsed since the reference signal was output.

The control device 402 illustrated in FIG. 10 has a function of controlling the overall operation of the image forming apparatus 10 (see FIG. 14). The hardware structure of the control device 402 is composed of a computer including a central processing unit (CPU), a read only memory (ROM) that stores programs for executing various processing routines, a random access memory (RAM) that temporarily stores data, a memory that serves as storage means, and a network interface (not illustrated).

Timing to Switch to Shunt Circuit and Timing to Switch Voltage Supplied to Application Roller In FIG. 8A, the second transfer roller 34 is illustrated on the left and right. The second transfer roller 34 that enters the recess 178 as the transfer cylinder 36 rotates is illustrated on the left, and the second transfer roller 34 that leaves the recess 178 as the transfer cylinder 36 rotates is illustrated on the right. Therefore, in practice, there is only one second transfer roller 34.

Referring to FIG. 8, a peripheral portion of the roller portion 174 of the transfer cylinder 36 excluding the recess 178 is referred to as a cylinder peripheral portion 179.

Figure 13:
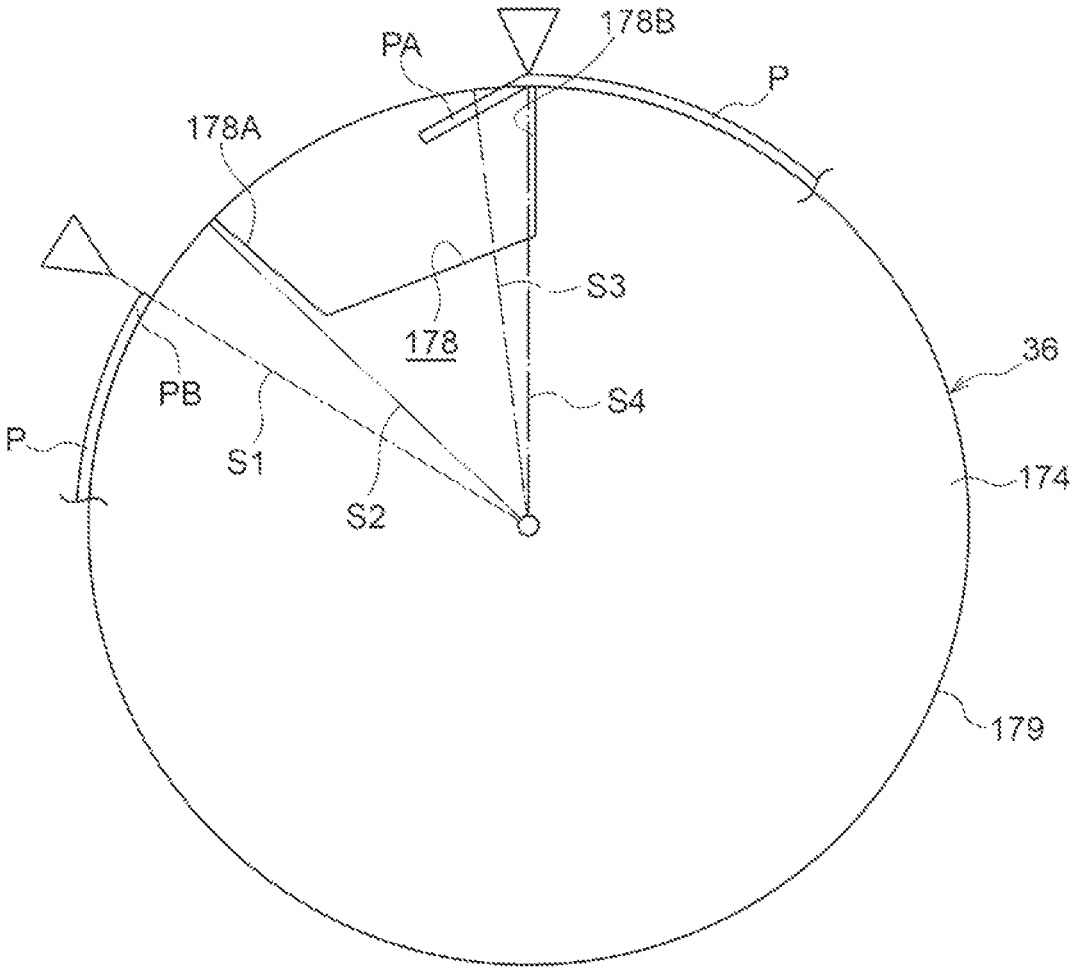
FIG. 13 is a diagram illustrating the timing for changing the voltage supplied by the power supply device for the transfer device according to the first exemplary embodiment of the present disclosure.
Figure 14:
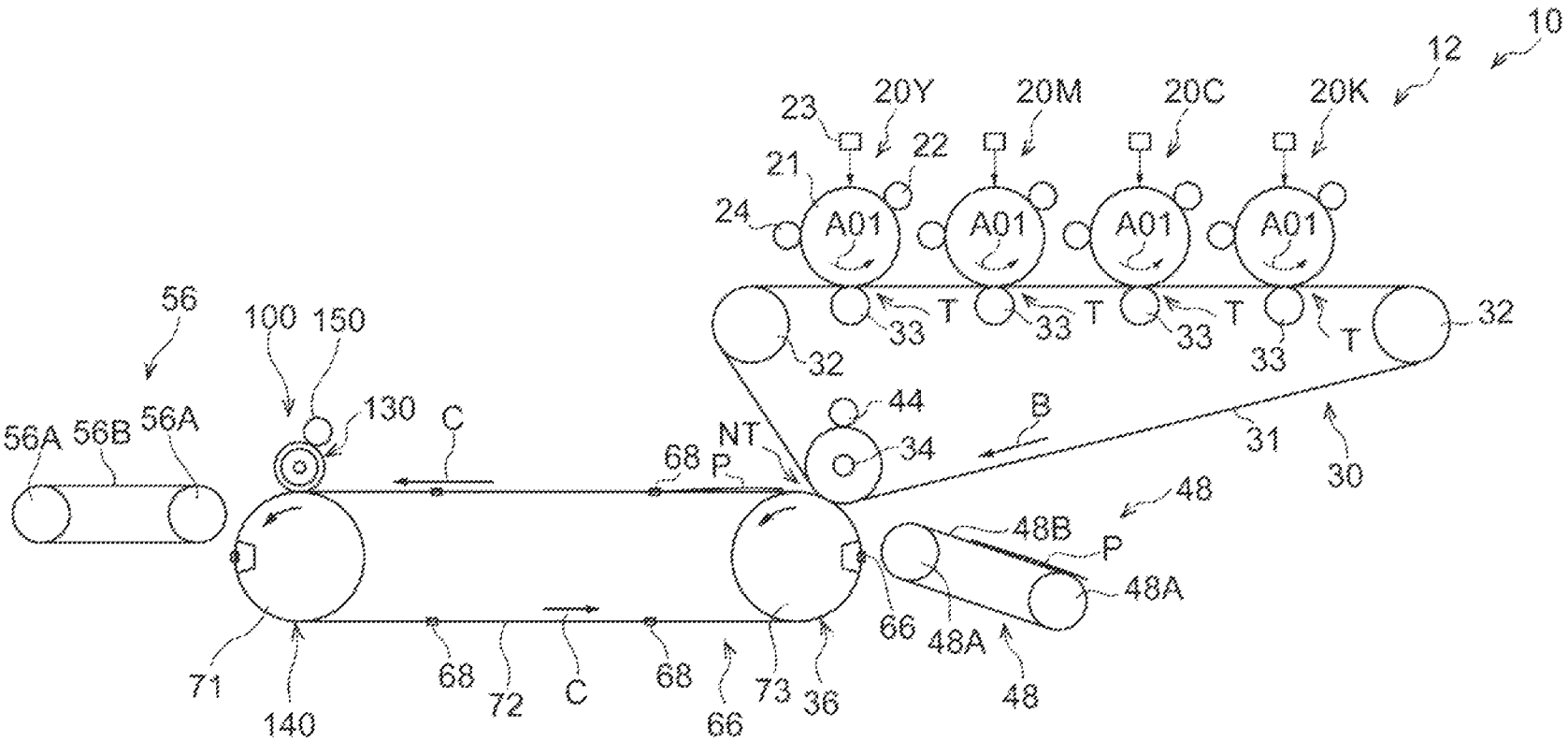
FIG. 14 is a schematic diagram that schematically illustrates the overall structure of an image forming apparatus according to the first exemplary embodiment of the present disclosure.

FIG. 13 is a diagram illustrating the timing for switching the voltage supplied by the power supply device 410 (see, for example, FIGS. 4A and 4B). FIG. 12 is the timing chart.

Timing to Switch from Transfer Voltage TV to Reverse Voltage GV

Referring to FIG. 4A, at the time when the second transfer position NT is moved to the position of line S1 shown in FIGS. 8A, 12, and 13 by the rotation of the transfer cylinder 36, the voltage supplied to the second transfer roller 34 by the power supply device 410 (see FIG. 10) is switched from the transfer voltage TV (see FIG. 12) to the reverse voltage GV (see FIG. 12). More specifically, the voltage is switched after passage of a set time period from the output of a reference signal and before switching to the shunt circuit 500 (see FIG. 10). As illustrated in FIGS. 4A, 8A, and 12, the voltage is switched before the second transfer position NT enters the recess 178 and while the second transfer position NT is on the jacket member 260. At this time, the second transfer position NT is at the same position as a trailing edge portion PB (FIG. 13) of the sheet member P.

Timing to Switch from Application Circuit 400 to Shunt Circuit 500

Referring to FIG. 4B, at the time when the second transfer position NT is moved to the position of line S2 illustrated in FIGS. 8A, 12, and 13 by the rotation of the transfer cylinder 36, the grounding member 182 comes into contact with the shaft member 34*a* (see FIG. 4B) of the second transfer roller 34 to switch to the shunt circuit 500 (see FIGS. 10 and 11) so that the generated current is shunted to the reference potential point G through the grounding member 182 and the resistive element 502. More specifically, the position of line S2 is the position at which the second transfer position NT is immediately in front of the recess 178 and is on the jacket member 260. The position of line S2 is downstream of the trailing edge portion PB of the sheet member P in the transporting direction.

Timing to Switch from Reverse Voltage GV to Intermediate Voltage CV and from Intermediate Voltage CV to Transfer Voltage TV Referring to FIG. 5A, at the time when the second transfer position NT is moved to the position of line S3 shown in FIGS. 8A, 12, and 13 by the rotation of the transfer cylinder 36, the voltage supplied to the second transfer roller 34 by the power supply device 410 is switched from the reverse voltage GV to the intermediate voltage CV. More specifically, the voltage is switched after passage of a set time period from the output of the reference signal and before the second transfer position NT leaves the recess 178. At this time, the generated current is shunted by the shunt circuit 500.

Then, after that, the voltage supplied by the power supply device 410 is switched from the intermediate voltage CV to the transfer voltage TV. The switching from the intermediate voltage CV to the transfer voltage TV is also performed before the second transfer position NT leaves the recess 178 and while the generated current is shunted by the shunt circuit 500. In addition, the voltage is switched after passage of a set time period from the output of the reference signal.

Timing to Switch from Shunt Circuit 500 to Application Circuit 400

Referring to FIG. 5B, at the time when the second transfer position NT is moved to the position of line S4 in FIGS. 8A, 12, and 13 by the rotation of the transfer cylinder 36, the grounding member 182 moves away from the shaft member 34*a* to switch from the shunt circuit 500 to the application circuit 400. At this time, the second transfer position NT is immediately behind the recess 178 and is on the jacket member 260.

The position of line S4 coincides or substantially coincides with the position of the inclination end 263B (see FIG. 8B) of the inclined surface 263A of the other end portion 263 of the jacket member 260. The voltage is increased to the transfer voltage TV by this time.

Operation of Relevant Structures

The operation of the relevant structures will now be described.

The sheet member P fed by the paper feed mechanism 48 illustrated in FIG. 14 is received and transported by the chain gripper 66. More specifically, the holding members 76 (see FIG. 6) of the chain gripper 66 hold the leading end of the sheet member P. Then, the chain gripper 66 transports the sheet member P.

As illustrated in FIGS. 3A, 3B, and 3C, when the holding members 76 holding the leading end of the sheet member P reach the transfer cylinder 36, the holding members 76 are received by the recess 178 in the roller portion 174. The sheet member P transported by the chain gripper 66 is transported while being wrapped around the transfer cylinder 36. The sheet member P that is transported is nipped between the roller portion 174 of the transfer cylinder 36 and the transfer belt 31 at the second transfer position NT. The toner images on the transfer belt 31 are transferred to the sheet member P by the transfer electric field.

More specifically, as illustrated in FIG. 4A, the contact roller 196 is in contact with the outer peripheral surface of the roller portion 174 until the downstream end of the recess 178, in which the holding members 76 are disposed, in the rotation direction reaches the second transfer position NT. The grounding member 182 is separated from the shaft member 34*a*, and the transfer electric field is generated at the second transfer position NT.

As illustrated in FIGS. 4A and 4B, the contact roller 196 that is contact with the outer peripheral surface of the roller portion 174 reaches the downstream end of the recess 178 in the rotation direction before the second transfer roller 34 reaches the downstream end of the recess 178 in the rotation direction.

Then, as illustrated in FIG. 4B, when the contact roller 196 reaches the downstream end of the recess 178 in the rotation direction, the body portion 194 of the switching member 190 rotates so that the grounding member 182 comes into contact with the shaft member 34*a*. Accordingly, the current generated by the voltage applied to the second transfer roller 34 by the application roller 44 flows through the grounding member 182, and the transfer electric field that has been generated at the second transfer position NT is eliminated.

Then, as illustrated in FIGS. 4B and 5A, as the transfer cylinder 36 rotates, the holding members 76 pass the second transfer roller 34, and then the contact roller 196 reaches the upstream end of the recess 178 in the rotation direction. While the contact roller 196 moves from the downstream end to the upstream end of the recess 178 in the rotation direction, the grounding member 182 is in contact with the shaft member 34*a*. Therefore, the transfer electric field is not generated at the second transfer position NT.

Then, as illustrated in FIGS. 5A and 5B, the contact roller 196 that has reached the upstream end of the recess 178 in the rotation direction comes into contact with the outer peripheral surface of the transfer cylinder 36. After the contact roller 196 has come into contact with the outer peripheral surface of the transfer cylinder 36, the wrapped portion of the outer peripheral surface of the transfer cylinder 36 that is wrapped with the sheet member P faces the second transfer roller 34, in other words, reaches the second transfer position NT.

As illustrated in FIG. 5B, when the contact roller 196 comes into contact with the outer peripheral surface of the roller portion 174, the body portion 194 of the switching member 190 rotates so that the grounding member 182 moves away from the shaft member 34*a*. Accordingly, the transfer electric field is generated at the second transfer position NT.

Thus, the outer peripheral surface and the recess 178 of the transfer cylinder 36 function as a cam surface so that the switching member 190 moves the grounding member 182 into contact with or away from the shaft member 34*a* in response to the rotation of the transfer cylinder 36.

The sheet member P is nipped between the roller portion 174 of the transfer cylinder 36 and the transfer belt 31 at the second transfer position NT. The toner images on the transfer belt 31 are transferred to the sheet member P by the transfer electric field at the second transfer position NT.

Effects

The effects of the relevant structures will now be described.

In the transfer device 30, when the second transfer position NT leaves the recess 178, the grounding member 182 moves away from the shaft member 34*a* to switch from the shunt circuit 500 to the application circuit 400. Therefore, the current generated by the voltage applied to the second transfer roller 34 flows to the transfer cylinder 36, and the transfer electric field is generated at the second transfer position NT.

The transfer electric field may instead be generated at the second transfer position NT by, for example, starting the application of the voltage to the second transfer roller 34 in response to an electric signal. In such a case, it takes a long time to complete the application of the transfer voltage TV to the second transfer roller 34 after the electric signal is output. In other words, it takes a long time to generate the transfer electric field.

In contrast, according to the transfer device 30, as described above, the transfer electric field is generated by moving the grounding member 182 away from the shaft member 34*a*. In other words, in the transfer device 30, the transfer electric field is generated in response to a mechanical operation instead of an electric signal. Therefore, according to the transfer device 30, the time required to generate the transfer electric field is shorter than that in the case where the application of the voltage to the second transfer roller 34 is started in response to an electric signal.

In addition, according to the transfer device 30, when the second transfer position NT enters the recess 178, the grounding member 182 comes into contact with the shaft member 34*a* to switch from the application circuit 400 to the shunt circuit 500. Accordingly, the current generated by the voltage applied to the second transfer roller 34 is shunted to the reference potential point G through the grounding member 182 and the resistive element 502. Thus, the transfer electric field that has been generated at the second transfer position NT is eliminated.

The transfer electric field that has been generated at the second transfer position NT may instead be eliminated by, for example, stopping the application of the voltage to the second transfer roller 34 in response to an electric signal. In such a case, it takes a long time to completely stop the application of the voltage to the second transfer roller 34 after the electric signal is output. In other words, it takes a long time to eliminate the transfer electric field.

In contrast, according to the transfer device 30, as described above, the transfer electric field is eliminated by bringing the grounding member 182 into contact with the shaft member 34*a*. In other words, in the transfer device 30, the transfer electric field is eliminated in response to a mechanical operation instead of an electric signal. Therefore, according to the transfer device 30, the time required to eliminate the transfer electric field is shorter than that in the case where the application of the voltage to the second transfer roller 34 is stopped in response to an electric signal.

As described above, according to the transfer device 30, the times required to generate and eliminate the transfer electric field are shorter than those in the case where the application of the transfer voltage TV to the second transfer roller 34 is started and stopped in response to an electric signal.

The applied voltage is switched from the transfer voltage TV to the reverse voltage GV in response to an electric signal before the operation of the shunt circuit 500 is started. Therefore, inrush current that flows into the shunt circuit 500 is less than that in the case where the voltage is maintained at the transfer voltage TV during the operation of the shunt circuit 500.

The applied voltage is switched from the reverse voltage GV to the intermediate voltage CV and then from the intermediate voltage CV to the transfer voltage TV in response to an electric signal during the operation of the shunt circuit 500. Therefore, the time required to generate the transfer electric field is shorter than that in the case where the applied voltage is directly switched from the reverse voltage GV to the transfer voltage TV.

The resistance value of the resistive element 502 is set in the range of greater than or equal to 1 MΩ and less than or equal to 4 MΩ. Therefore, the inrush current that flows into the shunt circuit 50 is less than that in the case where the resistance value of the resistive element 502 through which the current is shunted to the reference potential point G is less than 1 MΩ.

The resistance value of the resistive element 502 is set to ½ of the volume resistance value of the second transfer roller 34 at the time when the transfer electric field is generated. Therefore, variation in the current output by the power supply device 410 is less than that in the case where the current is shunted to the reference potential point G through a resistive element having the same resistance value as that of the second transfer roller 34 at the time when the transfer electric field is generated.

This will be described in more detail.

Referring to FIG. 11, a resistance portion 19A is a resistance component of the roller portion 34*b* of the second transfer roller 34 in a region from the contact position between the roller portion 34*b* and the application roller 44 to the shaft member 34*a*. A resistance portion 19B is a resistance component of the roller portion 34*b* of the second transfer roller 34 in a region from the shaft member 34*a* to the transfer cylinder 36. The resistance portion 19A and the resistance portion 19B have the same resistance value. Although the resistance portion 19B includes a resistance component of the transfer belt 31 to be accurate, the resistance component of the transfer belt 31 is ignored herein.

The current that flows through the application circuit 400 is approximately given as "transfer voltage TV/(resistance value of resistance portion 19A+resistance value of resistance portion 19B)".

In the shunt circuit 500, the grounding member 182 is in contact with the shaft member 34*a*. Therefore, the current that flows through the shunt circuit 500 is approximately given as "transfer voltage TV/(resistance value of resistance portion 19A+resistance value of resistive element 502)". Therefore, when the resistance value of the resistive element 502 is set to be equal to the resistance value of the resistance portion 19B, that is, ½ of the volume resistance value of the second transfer roller 34, variation in the current output by the power supply device 410 due to switching between the application circuit 400 and the shunt circuit 500 is reduced.

In addition, the inrush current that flows into the shunt circuit 500 is less than that in the case where the current is shunted from the power supply device 410 to the reference potential point G by the shunt circuit 500.

The position of line S1 on which the second transfer position NT is disposed at the time of switching from the application circuit 400 to the shunt circuit 500 is on the jacket member 260. Therefore, the transfer electric field is not generated at the second transfer position NT when the second transfer position NT leaves the jacket member 260. Accordingly, the risk of leakage from the second transfer roller 34 to the cylinder body 252, which is made of a metal, is less than that in the case where the switching to the shunt circuit 500 occurs while the second transfer position NT is not on the jacket member 260.

The position of line S4 on which the second transfer position NT is disposed at the time of switching from the shunt circuit 500 to the application circuit 400 is on the jacket member 260. Therefore, the transfer electric field is not generated at the second transfer position NT until the second transfer position NT reaches the jacket member 260. Accordingly, the risk of leakage from the second transfer roller 34 to the cylinder body 252, which is made of a metal, is less than that in the case where the switching to the application circuit 400 occurs while the second transfer position NT is not on the jacket member 260.

In the transfer device 30, the switching member 190 moves the grounding member 182 into contact with and away from the shaft member 34*a* in response to the rotation of the transfer cylinder 36. Therefore, the transfer electric field is generated and eliminated in response to the rotation of the transfer cylinder 36.

According to the transfer device 30, the outer peripheral surface and the recess 178 of the transfer cylinder 36 function as a cam surface so that the switching member 190 moves the grounding member 182 into contact with and away from the shaft member 34*a* in response to the rotation of the transfer cylinder 36. Therefore, the number of components is less than that in the case where a dedicated member having a cam surface is provided.

In addition, according to the transfer device 30, the switching member 190 has a U-shape when viewed in the apparatus width direction, and rotates about the rotating shaft portion 192 provided on the curved portion 194*c* to move the grounding member 182 into contact with and away from the shaft member 34*a*. Therefore, the length of the switching member 190 in the longitudinal direction is less than that of a switching member having a seesaw structure that extends in one and the other directions from a rotating shaft portion.

In addition, according to the transfer device 30, as the transfer cylinder 36 rotates, the contact roller 196 reaches the outer peripheral surface of the transfer cylinder 36 after the holding members 76 pass the second transfer roller 34. Thus, the grounding member 182 is in contact with the shaft member 34*a* when the holding members 76 face the second transfer roller 34. In other words, the transfer electric field is not generated at the second transfer position NT when the holding members 76 face the second transfer roller 34. In other words, the transfer electric field is not generated at the second transfer position NT when the holding members 76 face the intersection point between the outer peripheral surface of the second transfer roller 34 and the line connecting the rotation center of the second transfer roller 34 and the rotation center of the transfer cylinder 36 as viewed in the apparatus depth direction.

Therefore, the risk that a current will flow from the second transfer roller 34 to the holding members 76 is less than that in the case where the transfer electric field is generated when the holding members 76 face the second transfer roller 34. The risk that a current will flow from the second transfer roller 34 to the holding members 76 is less than that in the case where the grounding member 182 is separated from the shaft member 34*a* when the holding members 76 face the second transfer roller 34.

In addition, according to the transfer device 30, since the risk that a current will flow from the second transfer roller 34 to the holding members 76 is less than that in the case where the grounding member 182 is separated from the shaft member 34*a* when the holding members 76 face the second transfer roller 34, the risk of malfunction of the transfer device 30 is reduced.

In addition, according to the transfer device 30, the contact roller 196 disposed in the recess 178 comes into contact with the outer peripheral surface of the transfer cylinder 36 before the wrapped portion of the outer peripheral surface of the transfer cylinder 36 that is wrapped with the sheet member P faces the second transfer roller 34. Therefore, the transfer electric field is generated at the second transfer position NT before the wrapped portion of the outer peripheral surface of the transfer cylinder 36 that is wrapped with the sheet member P faces the second transfer roller 34.

In addition, according to the transfer device 30, the grounding member 182 is separated from the shaft member 34*a* when the second transfer roller 34 faces the portion of the transfer cylinder 36 that is wrapped with the sheet member P. In other words, the transfer electric field is generated at the second transfer position NT when the second transfer roller 34 faces the portion of the transfer cylinder 36 that is wrapped with the sheet member P. Therefore, the area in which the toner images may be transferred to the sheet member P is larger than that in the case where the grounding member 182 is in contact with the shaft member 34*a* when the second transfer roller 34 faces the leading end portion of the sheet member P that is wrapped around the transfer cylinder 36.

In addition, according to the transfer device 30, the contact roller 196 disposed in the recess 178 comes into contact with the outer peripheral surface of the transfer cylinder 36 before the second transfer roller 34 reaches the portion of the outer peripheral surface of the transfer cylinder 36 that is wrapped with the sheet member P. In other words, the transfer electric field is generated before the second transfer roller 34 reaches the portion of the outer peripheral surface of the transfer cylinder 36 that is wrapped with the sheet member P. Therefore, the toner images may be transferred to the leading end portion of the sheet member P wrapped around the transfer cylinder 36.

The image forming apparatus 10 includes the transfer device 30. Therefore, image defects formed on the sheet member P due to an unnecessary transfer electric field are less than those in the case where the image forming apparatus 10 includes a transfer device that stops the application of the voltage to the second transfer roller 34 in response to an electric signal. For example, the amount of margin at the leading end of the sheet member P due to an unnecessary transfer electric field may be reduced.

The reduction in the amount of margin at the leading end of the sheet member P due to an unnecessary transfer electric field will now be described in detail.

In the transfer device 30 according to the present exemplary embodiment, to prevent leakage between the second transfer roller 34 and the holding members 76 made of a metal or between the second transfer roller 34 and the cylinder body 252 made of a metal, switching from the shunt circuit 500 to the application circuit 400 is performed when the second transfer position NT is at the position of line S4. The toner images are not transferred to the leading end portion of the sheet member P until the transfer electric field is fully generated at the second transfer position NT. Therefore, a margin in which no images are transferred is formed at the leading end while the transfer electric field is not fully generated after the second transfer position NT has reached the position of line S4.

As described above, according to the transfer device 30 of the present exemplary embodiment, the time required to generate the transfer electric field is shorter than that in the case where the application of the voltage to the second transfer roller 34 is started in response to an electric signal. Therefore, according to the transfer device 30 of the present exemplary embodiment, the amount of margin at the leading end of the sheet member P is less than that in the case where the application of the voltage to the second transfer roller 34 is started in response to an electric signal.

The image forming apparatus 10 includes the application roller 44 that is in contact with the second transfer roller 34. When the grounding member 182 comes into contact with the shaft member 34*a* while electricity is supplied to the shaft portion of the application roller 44, a current of the electricity flows to the shaft member 34*a* through the surface of the second transfer roller 34 and the interior of the second transfer roller 34. The surface and interior of the second transfer roller 34 function as a resistance. Therefore, the risk that a large current will flow through a grounding path is less than that in the case where the electricity is supplied to the shaft member 34*a* to generate the transfer electric field.

Second Exemplary Embodiment

Examples of a transfer device and an image forming apparatus according to a second exemplary embodiment of the present disclosure will now be described with reference to FIG. 16. Differences between the second exemplary embodiment and the first exemplary embodiment will be basically described.

Figure 16:
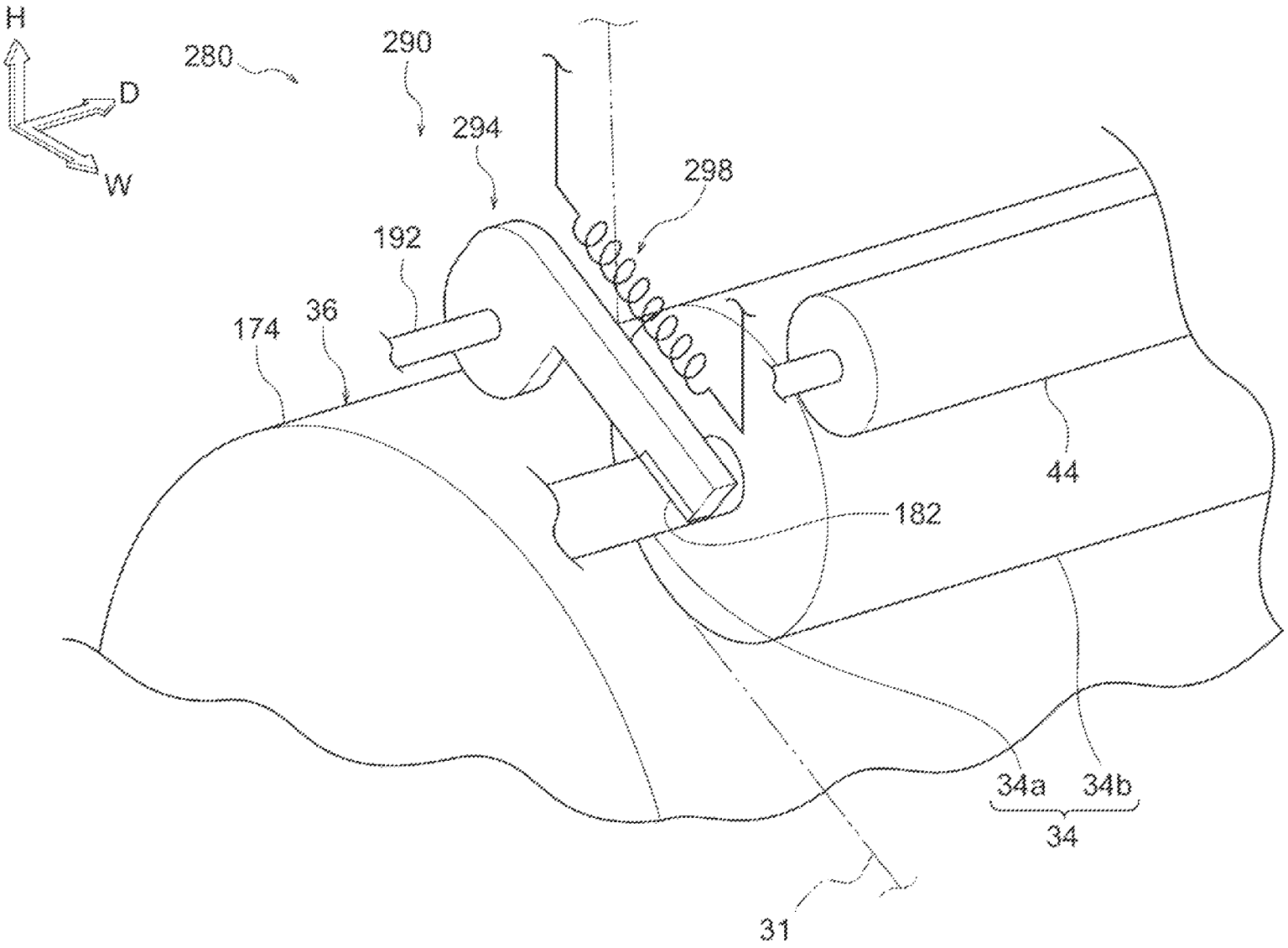
FIG. 16 is a perspective view of a switching unit and other components included in a transfer device according to a second exemplary embodiment of the present disclosure.

As illustrated in FIG. 16, a grounding unit 280 included in a transfer device according to a second exemplary embodiment includes a grounding member 182 and a switching member 290 that moves the grounding member 182 into contact with and away from the shaft member 34*a*.

The switching member 290 includes a rotating shaft portion 192, a body portion 294, and an excitation coil 298.

The body portion 294 is made of iron, and extends from the rotating shaft portion 192. An end portion of the body portion 294 is disposed to face the transfer cylinder 36 with the shaft member 34*a* disposed therebetween. The body portion 294 supports the grounding member 182. The body portion 294 rotates about the rotating shaft portion 192. The body portion 294 is an example of a support portion.

The excitation coil 298 faces the shaft member 34*a* with the body portion 294 disposed therebetween, and extends in a direction similar to the direction in which the body portion 294 extends.

In this structure, a low-voltage power supply (not illustrated) starts and stops the flow of electricity through the excitation coil 298. Accordingly, a magnetic field is generated around the excitation coil 298, so that the body portion 294 rotates in one or the other direction. Thus, the grounding member 182 is moved into contact with or away from the shaft member 34*a*.

The second exemplary embodiment provides effects other than those obtained by moving the grounding member 182 into contact with and away from the shaft member 34*a* in response to the rotation of the transfer cylinder 36. The voltage supplied to the excitation coil 298 is less than the voltage supplied to the application roller 44. Therefore, according to the excitation coil 298, the flow of electricity may be electrically started and stopped more quickly than when the application roller 44 is used to electrically start and stop the flow of electricity.

Others

The present disclosure is not limited to the above-described exemplary embodiments.

Although the applied voltage is switched from the reverse voltage GV to the intermediate voltage CV and then from the intermediate voltage CV to the transfer voltage TV in the above-described exemplary embodiments, the applied voltage is not limited to this. The applied voltage may instead be switched directly from the reverse voltage GV to the transfer voltage TV.

In addition, for example, although the applied voltage is switched from the transfer voltage TV to the reverse voltage GV while the shunt circuit 500 is in operation in the above-described exemplary embodiments, the applied voltage is not limited to this. The applied voltage may be maintained at the transfer voltage TV while the shunt circuit 500 is in operation, or be set to a potential equal to that of the reference potential point G while the shunt circuit 500 is in operation. Alternatively, the applied voltage may be set to a standby voltage having an absolute value less than that of the transfer voltage TV while the shunt circuit 500 is in operation. The standby voltage may, for example, be equal to the intermediate voltage CV.

In addition, for example, although the holding members 76, which are examples of a retaining member, are structured to physically hold the leading end portion of the sheet member P in the above-described exemplary embodiments, the retaining member is not limited to this. The leading end portion of the sheet member P may instead be held by, for example, air suction.

In addition, for example, although the chains are used as circulating members in the above-described exemplary embodiments, the circulating members are not limited to this. For example, the circulating members may instead be belts.

In addition, for example, although the toner images are transferred to the sheet member P from the transfer belt 31 in the above-described exemplary embodiments, the toner images may instead be transferred to the sheet member P from a transfer roller.

In addition, although the image forming apparatus 10 includes the application roller 44 that is in contact with the second transfer roller 34, the application roller 44 may be omitted, and electricity may be supplied to the shaft member 34*a* of the second transfer roller 34. However, in the case where the application roller 44 is provided, the risk that a large current will flow though the shunt circuit 500 when the current is grounded may be reduced. This is because when the grounding member 182 comes into contact with the shaft member 34*a* while electricity is supplied to the shaft portion of the application roller 44, a current of the electricity flows to the shaft member 34*a* through the surface and interior of the second transfer roller 34, and the surface and interior of the second transfer roller 34 function as a resistance.

A non-contact auxiliary heating unit, an air blowing unit for blowing air from below the sheet member P to stabilize the position of the sheet member P that is transported, and other components may be disposed between the fixing device 100 and the second transfer position NT.

The switching member 190 is not limited to those operated by the transfer cylinder 36 serving as a cam surface. For example, the switching member 190 may instead be operated by, for example, a cam that rotates together with the transfer cylinder 36.

It is not necessary that the switching member swing and come into contact with the shaft member 34*a* to switch to the shunt circuit. For example, the switching member may instead swing and come into contact with a portion other than the shaft member 34*a*, for example, a shaft member 44*a* of the application roller 44 to switch to the shunt circuit. Also, the switching member may be structured to move straight, for example, instead of swinging. The operation stopping mechanism may be any mechanism capable of switching to the shunt circuit by which the voltage applied to the transfer member is shunted to the reference potential point instead of being applied to the transfer cylinder.

In addition, although the outer peripheral surface of the roller portion 174 of the transfer cylinder 36 serves as a cam surface in the above-described first exemplary embodiment, a dedicated member having a cam surface may be attached to one of the shaft portions 176 of the transfer cylinder 36. However in such a case, the effects obtained when the outer peripheral surface of the roller portion 174 serves a cam surface cannot be obtained.

Figure 17:
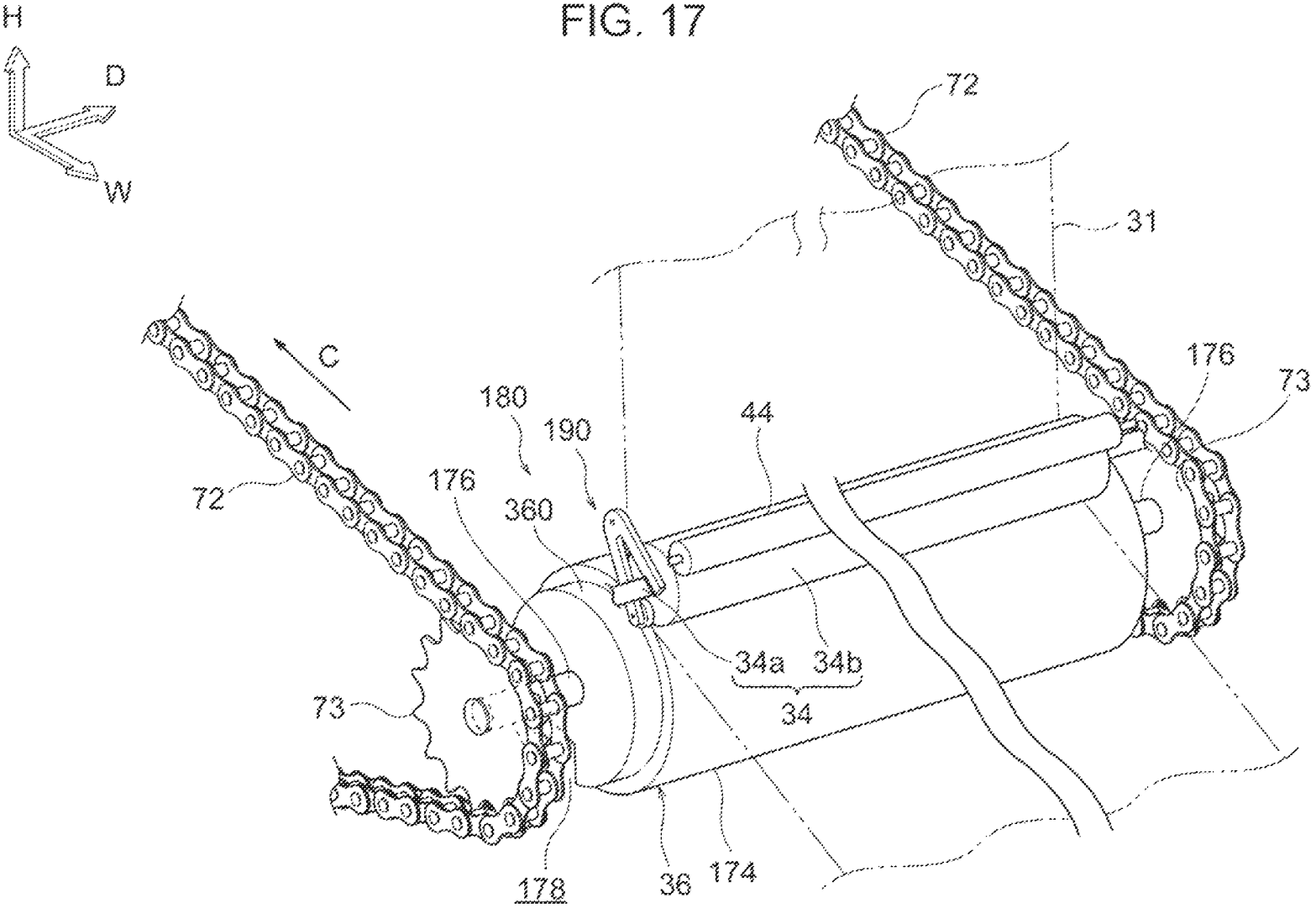
FIG. 17 is a perspective view of a second transfer roller, an opposing roller, a switching unit, and other components included in a transfer device according to a modification.

Referring to FIG. 17, which illustrates a modification, an end portion of the roller portion 174 of the transfer cylinder 36 in the apparatus depth direction may have a cam surface 360 having a shape that differs from the shape of other portions in the apparatus depth direction. The switching member 190 may be rotated by this cam surface 360. In such a case, the second transfer roller 34 may be switched between the grounded and non-grounded states by the grounding member 182 without being affected by the shape of a central portion of the transfer cylinder 36 in the apparatus depth direction.

In addition, although the transfer cylinder 36 is described as a transfer cylinder in the above-described exemplary embodiment, the transfer cylinder may instead be, for example, a component obtained by wrapping a belt around the transfer cylinder 36.

In addition, although the holding members 76 are attached to the pair of chains 72 in the above-described first exemplary embodiment, the holding members 76 may instead be attached to, for example, the transfer cylinder 36.

In addition, although the holding members 76 are provided in the above-described exemplary embodiment, the holding members may be omitted.

In addition, although the switching member 190 is rotated in response to the rotation of the transfer cylinder 36 by a cam mechanism in the above-described exemplary embodiment, the switching member 190 may instead be rotated in response to the rotation of the transfer cylinder 36 by other mechanisms.

The expression "in response to the rotation of the transfer cylinder 36" means that the cam mechanism, for example, is physically operated by the rotation of the transfer cylinder 36 to move the grounding member 182 into contact with and away from the shaft member 34*a*. Therefore, a structure in which, for example, the rotation is detected by an additionally provided sensor and in which the grounding member 182 is moved into contact with and away from the shaft member 34*a* in response to an electric signal based on the detected rotation is not included.

The structure of the image forming apparatus is not limited to the structure in the above-described exemplary embodiments, and various structures are possible. Also, various exemplary embodiments are possible within the gist of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer device comprising:

a transfer member to which a voltage is applied by a power supply device to generate a transfer electric field for transferring a developer image to a recording medium;

a transfer cylinder having a recess in which a retaining member that retains a leading end portion of the recording medium is disposed, the transfer electric field being generated between the transfer cylinder and the transfer member at a transfer position;

a shunt circuit by which the voltage applied to the transfer member is shunted to a reference potential point; and an operation stopping mechanism that starts and stops an operation of the shunt circuit in response to rotation of the transfer cylinder, the operation being started when the recess reaches the transfer position and stopped when the recess leaves the transfer position.

2. The transfer device according to claim 1, wherein the power supply device is capable of switching the voltage applied to the transfer member between a transfer voltage at which the transfer electric field for transferring the developer image to the recording medium is generated and a standby voltage having an absolute value less than an absolute value of the transfer voltage, wherein the voltage applied to the transfer member is switched from the transfer voltage to the standby voltage before the operation of the shunt circuit is started, and wherein the voltage applied to the transfer member is switched from the standby voltage to the transfer voltage before the operation of the shunt circuit is stopped.

3. The transfer device according to claim 1, wherein the power supply device is capable of switching the voltage applied to the transfer member between a transfer voltage at which the transfer electric field for transferring the developer image to the recording medium is generated and a reverse voltage having a polarity opposite to a polarity of the transfer voltage, wherein the voltage applied to the transfer member is switched from the transfer voltage to the reverse voltage before the operation of the shunt circuit is started, and wherein the voltage applied to the transfer member is switched from the reverse voltage to the transfer voltage before the operation of the shunt circuit is stopped.

4. The transfer device according to claim 3, wherein the power supply device is capable of switching the voltage applied to the transfer member between the transfer voltage, the reverse voltage, and an intermediate voltage that is between the transfer voltage and the reverse voltage, and wherein the voltage applied to the transfer member is switched from the reverse voltage to the intermediate voltage and from the intermediate voltage to the transfer voltage before the operation of the shunt circuit is stopped.

5. The transfer device according to claim 1, wherein the shunt circuit includes a resistive element through which the voltage applied to the transfer member is shunted to the reference potential point, the resistive element having a resistance value of greater than or equal to 1 MΩ and less than or equal to 4 MΩ.

6. The transfer device according to claim 1, wherein the shunt circuit includes a resistive element through which the voltage applied to the transfer member is shunted to the reference potential point, the resistive element having a resistance value that is ½ of a resistance value of the transfer member at a time when the transfer electric field is generated.

7. The transfer device according to claim 1, wherein the transfer member rotates around a shaft member made of a metal, wherein the power supply device includes an application member that applies the voltage to the transfer member by coming into contact with an outer peripheral surface of the transfer member, wherein the shaft member is shunted by the shunt circuit, and wherein the operation stopping mechanism includes:

a grounding member that is capable of moving into contact with and away from the shaft member and that comes into contact with the shaft member to shunt the shaft member; and a switching member that moves the grounding member into contact with and away from the shaft member in response to the rotation of the transfer cylinder.

8. The transfer device according to claim 1, wherein the transfer cylinder includes:

a cylinder body that has a cylindrical shape and in which the recess is formed; and an outer peripheral portion provided on an outer peripheral surface of the cylinder body, and wherein the operation stopping mechanism starts the operation of the shunt circuit to shunt the voltage applied to the transfer member while the transfer position is on the outer peripheral portion.

9. The transfer device according to claim 8, wherein the operation stopping mechanism stops the operation of the shunt circuit while the transfer position is on the outer peripheral portion.

10. An image forming apparatus comprising:

an image forming unit that forms a developer image; and the transfer device according to claim 1, the transfer device transferring the developer image formed by the image forming unit to the recording medium.

11. A transfer device comprising:

a transfer member that rotates around a shaft member and generates a transfer electric field for transferring a developer image to a recording medium;

an application member that comes into contact with the transfer member to apply a voltage to the transfer member;

a grounding member that is capable of moving into contact with and away from the shaft member and that comes into contact with the shaft member to ground the transfer member; and a transfer cylinder that rotates and around which the recording medium that is transported is wrapped, the transfer electric field being generated between the transfer cylinder and the transfer member, wherein a switching member moves the grounding member into contact with and away from the shaft member in response to rotation of the transfer cylinder.

12. The transfer device according to claim 11, wherein the transfer cylinder has a circular cross-section, and wherein the switching member moves the grounding member into contact with and away from the shaft member in response to the rotation of the transfer cylinder by using an outer peripheral surface of the transfer cylinder as a cam surface.

13. The transfer device according to claim 12, wherein the switching member has a U-shape when viewed in an axial direction of the shaft member, and wherein the switching member includes:

a rotating shaft portion that is provided on a curved portion of the U-shape and that extends in the axial direction;

a contact portion that is provided on one tine portion of the U-shape, the contact portion rotating around the rotating shaft portion and coming into contact with the outer peripheral surface of the transfer cylinder; and a support portion that is provided on other tine portion of the U-shape, the support portion rotating around the rotating shaft portion and supporting the grounding member.

14. The transfer device according to claim 13, further comprising:

a transport member that transports the recording medium, the transport member including a holding member that holds a leading end of the recording medium, wherein the switching member operates so that the grounding member is in contact with the shaft member while the holding member and the transfer member face each other.

15. The transfer device according to claim 14, wherein a recess that extends in the axial direction and in which the holding member is disposed is formed in the outer peripheral surface of the transfer cylinder, wherein the recording medium held by the holding member disposed in the recess is wrapped around the outer peripheral surface of the transfer cylinder, wherein the switching member operates so that the grounding member is separated from the shaft member while the contact portion is in contact with the outer peripheral surface of the transfer cylinder and so that the grounding member is in contact with the shaft member while the contact portion is disposed in the recess in the transfer cylinder, and wherein the contact portion disposed in the recess comes into contact with the outer peripheral surface of the transfer cylinder before a portion of the outer peripheral surface of the transfer cylinder faces the transfer member, the portion having the recording medium wrapped therearound.

16. A transfer device comprising:

a transfer member that rotates around a shaft member and to which a voltage is applied to generate a transfer electric field for transferring a developer image to a recording medium;

a transfer cylinder that faces the transfer member and that rotates, the transfer electric field being generated between the transfer cylinder and the transfer member;

a grounding member that is capable of moving into contact with and away from the shaft member and that comes into contact with the shaft member to ground the transfer member; and a switching member that moves the grounding member into contact with and away from the shaft member in response to rotation of the transfer cylinder.

17. The transfer device according to claim 16, further comprising:

a transport member that transports the recording medium, the transport member including a holding member that holds a leading end of the recording medium, wherein the switching member operates so that the grounding member is in contact with the shaft member while the transfer member faces the holding member.

18. The transfer device according to claim 17, wherein a recess that extends in an axial direction of the shaft member and in which the holding member is disposed is formed in an outer peripheral surface of the transfer cylinder, and wherein the switching member moves the grounding member to switch the transfer member between grounded and non-grounded states in response to the rotation of the transfer cylinder by using a portion of the transfer cylinder as a cam surface.

19. The transfer device according to claim 18, wherein the cam surface is formed on an end portion of the transfer cylinder in the axial direction and has a shape that differs from a shape of other portions in the axial direction.

20. The transfer device according to claim 18, wherein the recording medium that is transported is wrapped around the transfer cylinder, and wherein the switching member operates so that the grounding member is separated from the shaft member while the transfer member faces a portion of the transfer cylinder, the portion having the recording medium wrapped therearound.

21. The transfer device according to claim 20, wherein the switching member includes:

a rotating shaft portion that extends in an axial direction of the shaft member; and a contact portion that rotates around the rotating shaft portion and that comes into contact with the outer peripheral surface of the transfer cylinder, wherein the switching member operates so that the grounding member is separated from the shaft member while the contact portion is in contact with the outer peripheral surface of the transfer cylinder and so that the grounding member is in contact with the shaft member while the contact portion is disposed in the recess, and wherein the contact portion disposed in the recess comes into contact with the outer peripheral surface of the transfer cylinder before the transfer member reaches a portion of the outer peripheral surface of the transfer cylinder, the portion having the recording medium wrapped therearound.

* * * * *